US007871357B2

(12) United States Patent
Gibson et al.

(10) Patent No.: US 7,871,357 B2
(45) Date of Patent: Jan. 18, 2011

(54) WEIGHT STACK SELECTOR

(75) Inventors: Ronald S. Gibson, Valencia, CA (US); Blakely T. Pennington, Everett, WA (US); David L. Albert, Woodinville, WA (US)

(73) Assignee: Precor Incorporated, Woodinville, WA (US)

( * ) Notice: Subject to any disclaimer, the term of this patent is extended or adjusted under 35 U.S.C. 154(b) by 249 days.

(21) Appl. No.: 12/004,236

(22) Filed: Dec. 20, 2007

(65) Prior Publication Data

US 2009/0163332 A1 Jun. 25, 2009

(51) Int. Cl.
*A63B 21/062* (2006.01)

(52) U.S. Cl. ..... 482/98

(58) Field of Classification Search ..... 482/98–103, 482/908

See application file for complete search history.

(56) References Cited

U.S. PATENT DOCUMENTS

| | | | | |
|---|---|---|---|---|
| 323,792 | A | 8/1885 | Coop et al. | 482/102 |
| 772,906 | A | 10/1904 | Reach | |
| 848,272 | A | 3/1907 | Thornley | |
| 1,053,109 | A * | 2/1913 | Reach | 482/99 |
| 3,627,315 | A | 12/1971 | Marcyan | 272/81 |
| 3,647,209 | A * | 3/1972 | La Lanne | 482/103 |
| RE28,066 | E | 7/1974 | Marcyan | 272/81 |
| 4,538,805 | A | 9/1985 | Parviainen | 482/98 |
| 4,546,970 | A | 10/1985 | Mahnke | 272/118 |
| 4,627,615 | A | 12/1986 | Nurkowski | 272/118 |
| 4,712,793 | A | 12/1987 | Harwick et al. | 482/99 |
| 4,817,943 | A | 4/1989 | Pipasik | 272/117 |
| 4,834,365 | A | 5/1989 | Jones | 482/100 |
| 4,971,305 | A | 11/1990 | Rennex | 482/93 |
| 5,123,885 | A | 6/1992 | Shields | 482/106 |
| 5,135,453 | A | 8/1992 | Sollenberger et al. | 482/101 |
| 5,306,221 | A * | 4/1994 | Itaru | 482/98 |
| 5,429,569 | A | 7/1995 | Gunnari et al. | 482/100 |
| 5,643,152 | A | 7/1997 | Simonson | 482/100 |
| 5,655,997 | A | 8/1997 | Greenberg et al. | 482/5 |
| 5,669,861 | A | 9/1997 | Toups | 482/98 |
| 5,776,040 | A | 7/1998 | Webb et al. | 482/98 |
| 5,785,632 | A | 7/1998 | Greenberg et al. | 482/5 |
| 5,839,997 | A | 11/1998 | Roth et al. | 482/107 |
| 5,876,313 | A | 3/1999 | Krull | 482/98 |
| 5,935,048 | A | 8/1999 | Krull | 482/98 |
| 5,944,642 | A | 8/1999 | Krull | 482/98 |
| 6,015,367 | A | 1/2000 | Scaramucci | 482/5 |
| 6,033,350 | A | 3/2000 | Krull | 482/98 |
| 6,117,049 | A | 9/2000 | Lowe | 482/4 |
| 6,126,579 | A | 10/2000 | Lin | 482/98 |
| 6,174,265 | B1 * | 1/2001 | Alessandri | 482/5 |
| 6,183,401 | B1 | 2/2001 | Krull | 482/98 |
| 6,186,927 | B1 | 2/2001 | Krull | 482/98 |
| 6,224,519 | B1 | 5/2001 | Doolittle | 482/98 |

(Continued)

FOREIGN PATENT DOCUMENTS

CA 2297577 A1 3/2001

(Continued)

*Primary Examiner*—Fenn C Mathew
*Assistant Examiner*—Andrew M Tecco
(74) *Attorney, Agent, or Firm*—Terence P. O'Brien; Todd A. Rathe

(57) ABSTRACT

A weight system includes a selector which is movable along weights and may be inserted into a void between adjacent weights.

18 Claims, 23 Drawing Sheets

U.S. PATENT DOCUMENTS

| | | | | |
|---|---|---|---|---|
| 6,322,481 | B1 | 11/2001 | Krull | 482/107 |
| 6,387,018 | B1 | 5/2002 | Krull | 482/98 |
| 6,387,019 | B1 | 5/2002 | Krull | 482/98 |
| 6,387,021 | B1 | 5/2002 | Miller, Jr. | 482/99 |
| 6,402,666 | B2 | 6/2002 | Krull | 482/107 |
| 6,422,979 | B1 | 7/2002 | Krull | 482/98 |
| 6,436,013 | B1 | 8/2002 | Krull | 482/94 |
| 6,447,432 | B1 | 9/2002 | Krull | 482/98 |
| 6,468,189 | B2 | 10/2002 | Alessandri | 482/99 |
| 6,497,639 | B2 | 12/2002 | Webber et al. | 482/98 |
| 6,540,650 | B1 | 4/2003 | Krull | 482/107 |
| 6,551,223 | B2 * | 4/2003 | Cheng | 482/99 |
| 6,629,910 | B1 | 10/2003 | Krull | 482/98 |
| 6,632,161 | B1 | 10/2003 | Nir | 482/98 |
| 6,666,800 | B2 * | 12/2003 | Krull | 482/94 |
| 6,669,606 | B2 | 12/2003 | Krull | 482/98 |
| 6,679,816 | B1 | 1/2004 | Krull | 482/107 |
| 6,719,672 | B1 | 4/2004 | Ellis et al. | 482/99 |
| 6,719,674 | B2 | 4/2004 | Krull | 482/106 |
| 6,733,424 | B2 | 5/2004 | Krull | 482/98 |
| 6,746,381 | B2 | 6/2004 | Krull | 482/108 |
| 6,749,547 | B2 | 6/2004 | Krull | 482/106 |
| 6,855,097 | B2 | 2/2005 | Krull | 482/107 |
| 6,896,645 | B1 | 5/2005 | Krull | 482/107 |
| 6,899,661 | B1 | 5/2005 | Krull | 482/107 |
| 6,902,516 | B2 | 6/2005 | Krull | 482/98 |
| 6,974,405 | B2 | 12/2005 | Krull | 482/107 |
| 6,997,856 | B1 | 2/2006 | Krull | 482/104 |
| 7,011,609 | B1 | 3/2006 | Kuo | 482/94 |
| 7,048,677 | B2 | 5/2006 | Mackert et al. | 482/102 |
| 7,060,011 | B1 | 6/2006 | Krull | 482/107 |
| 7,066,867 | B2 | 6/2006 | Krull | 482/108 |
| 7,077,790 | B1 | 7/2006 | Krull | 482/106 |
| 7,077,791 | B2 | 7/2006 | Krull | 482/108 |
| 7,090,623 | B2 | 8/2006 | Stewart et al. | 482/100 |
| 7,128,696 | B1 | 10/2006 | Krull | 482/107 |
| 7,128,697 | B1 | 10/2006 | Krull | 482/108 |
| 7,153,243 | B1 | 12/2006 | Krull | 482/107 |
| 7,179,208 | B1 | 2/2007 | Nalley | 482/99 |
| 7,252,627 | B2 | 8/2007 | Carter | 482/98 |
| 7,413,532 | B1 * | 8/2008 | Monsrud et al. | 482/99 |
| 7,473,211 | B2 * | 1/2009 | Lee | 482/97 |
| 7,540,832 | B2 * | 6/2009 | Krull | 482/98 |
| 7,608,021 | B1 * | 10/2009 | Nalley | 482/98 |
| 7,608,023 | B2 * | 10/2009 | Casagrande | 482/100 |
| 2002/0049123 | A1 | 4/2002 | Krull | 482/98 |
| 2002/0151413 | A1 | 10/2002 | Dalebout et al. | 482/54 |
| 2003/0040407 | A1 | 2/2003 | Rothacker | 482/106 |
| 2003/0092542 | A1 | 5/2003 | Bartholomew et al. | 482/99 |
| 2005/0176559 | A1 | 8/2005 | Carter | 482/94 |
| 2006/0205571 | A1 | 9/2006 | Krull | 482/94 |
| 2006/0217245 | A1 | 9/2006 | Golesh et al. | 482/94 |
| 2007/0149366 | A1 | 6/2007 | Kuo | 482/98 |
| 2008/0242520 | A1 * | 10/2008 | Hubbard | 482/98 |

FOREIGN PATENT DOCUMENTS

| | | | |
|---|---|---|---|
| DE | 202004006399 | U1 | 7/2004 |
| DE | 10 2004 029 509 | A1 | 1/2005 |
| EP | 1031359 | A1 | 8/2000 |
| EP | 1614450 | A1 | 11/2006 |
| FR | 1 304 844 | A | 9/1962 |
| FR | 2613237 | A1 * | 10/1988 |
| JP | 10118222 | A | 5/1998 |
| SU | 1347948 | A | 10/1987 |
| SU | 1644983 | A | 4/1991 |
| WO | WO 95/00210 | | 9/1962 |
| WO | WO 2005009547 | A1 | 2/2005 |

* cited by examiner

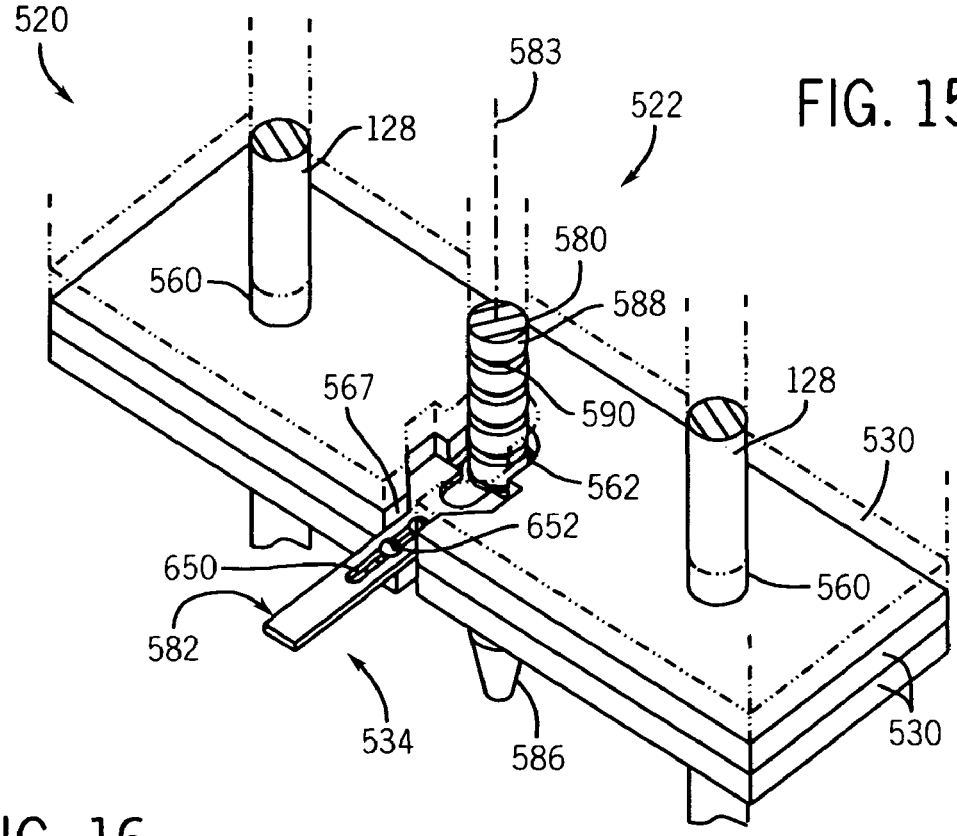
FIG. 15
FIG. 16
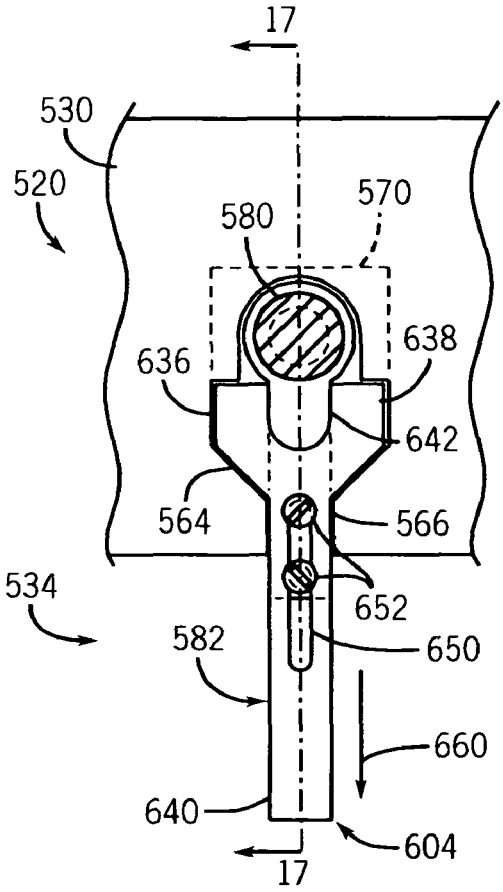
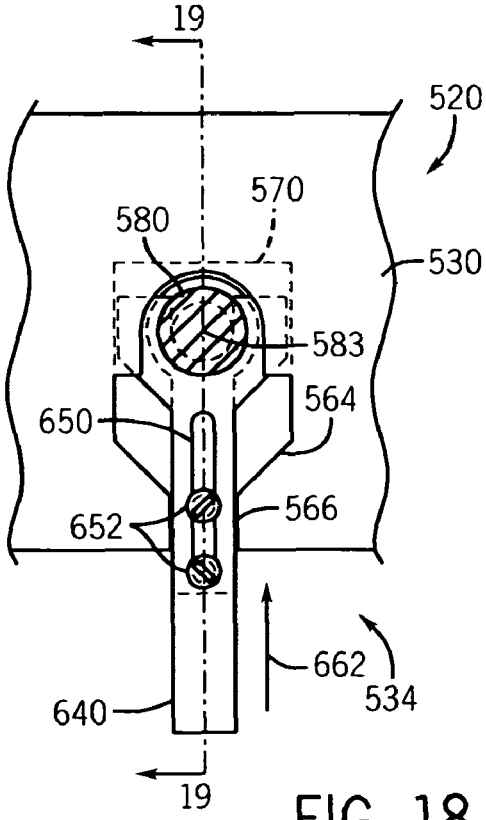
FIG. 18

FIG. 17
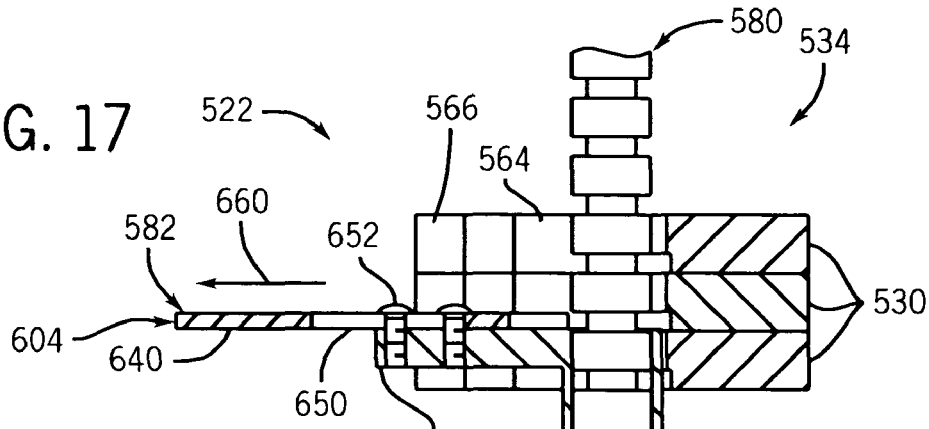
FIG. 19
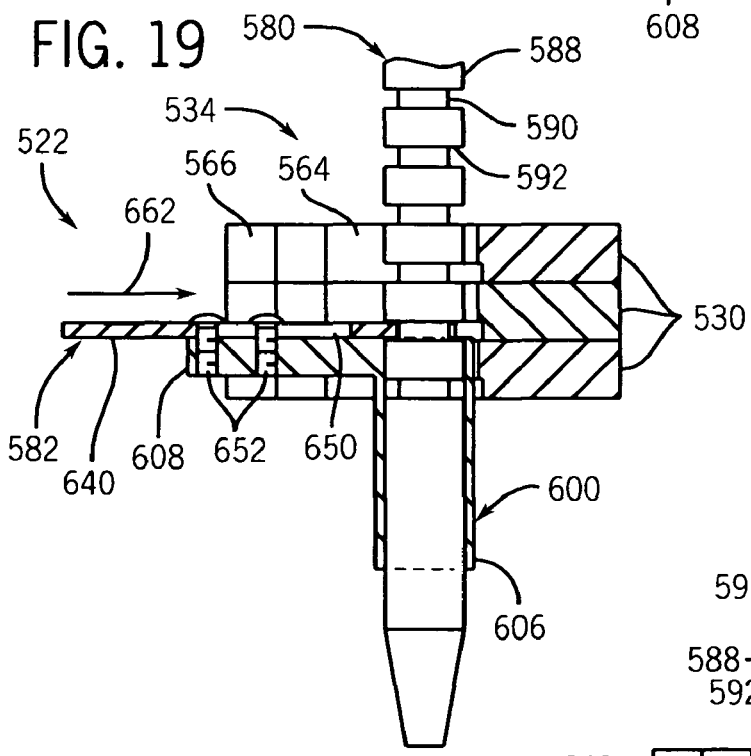
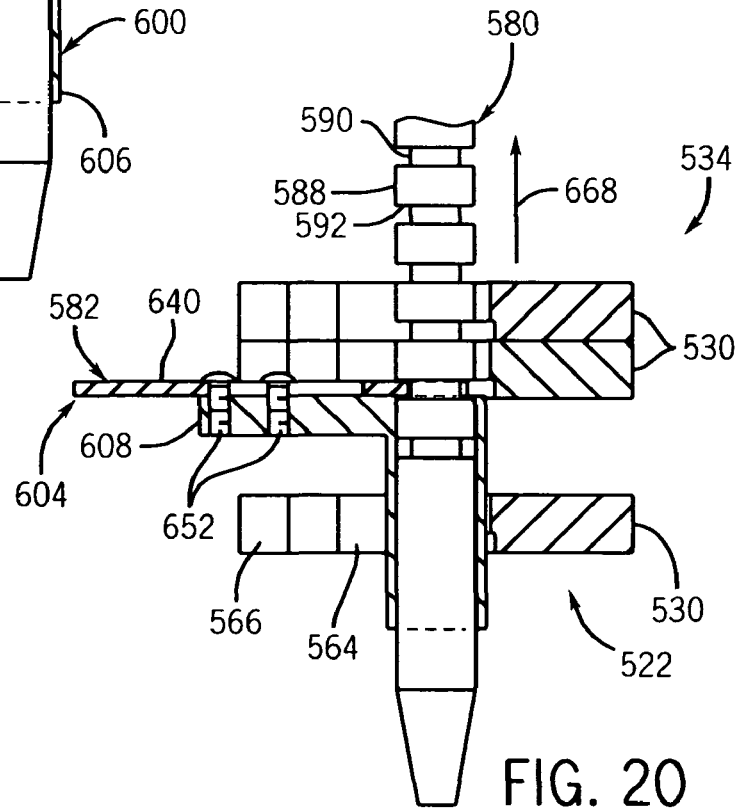
FIG. 20

WEIGHT STACK SELECTOR

CROSS-REFERENCE TO RELATED PATENT APPLICATIONS

The present application is related to co-pending U.S. patent application Ser. No. 12/004,303 filed on the same day herewith by Ronald S. Gibson, Blakely T. Pennington and David L. Albert and entitled INCREMENTAL WEIGHT AND SELECTOR, the full disclosure of which is hereby incorporated by reference. The present application is related to co-pending U.S. patent application Ser. No. 12/004,253 filed on the same day herewith by Ronald S. Gibson, David E. Dyer and Jonathan M. Stewart and entitled WEIGHT STACK SELECTOR, the full disclosure of which is hereby incorporated by reference.

BACKGROUND

Stacks of weights are sometimes employed in exercise devices and in other testing or calibration equipment to permit different total weight amounts to be selected for being lifted, dropped or applied. In exercise devices, selection of weights is sometimes performed using a removable pin. Such pins may be lost, misplaced or stolen. Use of the pin is sometimes difficult, tedious and time-consuming. Moreover, fabrication of the weights for use with the pin may be costly.

BRIEF DESCRIPTION OF THE DRAWINGS

FIG. 15 is a fragmentary top perspective view of another embodiment of the exercise device of FIG. 1 according to an example embodiment.

FIG. 16 is a fragmentary top plan view of the system of FIG. 15 illustrating a weight selector in a first state according to an example embodiment.

FIG. 17 is a sectional view of the system of FIG. 16 taken along line 17-17 according to an example embodiment.

FIG. 18 is a fragmentary top plan view of the system of FIG. 15 illustrating a weight selector in a second state according to an example embodiment.

FIG. 19 is a sectional view of the system of FIG. 18 taken along line 19-19 according to an example embodiment.

FIG. 20 is a fragmentary sectional view of the system of FIG. 19 during lifting of the weights according to an example embodiment.

DETAILED DESCRIPTION OF THE EXAMPLE EMBODIMENTS

Figure 1:
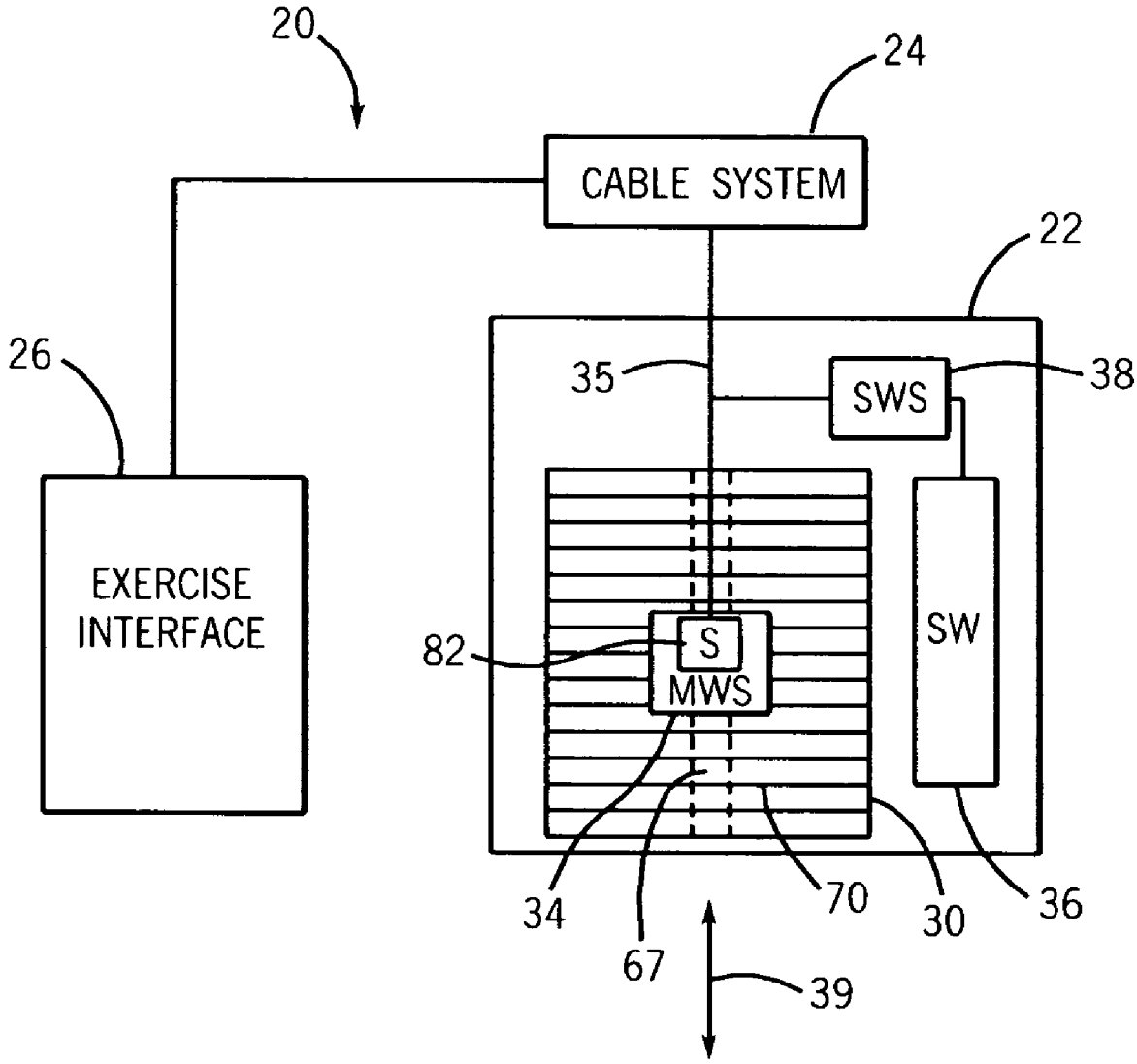
FIG. 1 is a schematic illustration of an exercise device including a weight system according to an example embodiment.

FIG. 1 schematically illustrates exercise device 20 according to one example embodiment. Exercise device 20 includes weight system 22, cable system 24 and exercise interface 26. Weight system 22 comprises a system by which a person may select a total amount of weight to be utilized and ultimately lifted in an exercise. Weight system 22 generally includes main weights 30, main weight selection system 34, weight lift 35, incremental weights 36 and incremental weight selection system 38.

Weights 30 comprise structures having predetermined weight amounts which are configured to be lifted and to provide a mechanical resistance in an exercise. In the particular example illustrated, weights 30 each comprise a solid or hollow plate of one or more metals. In other embodiments, weights 30 may comprise other materials or may comprise encapsulated materials, such as sand, water or other materials. Weights 30 are stacked upon one another such that as a particular weight 30 is being lifted, other weights 30 stacked upon the particular weight 30 are also lifted.

As schematically represented in FIG. 1, weights 30 each have a front rearwardly and horizontally extending notch or cutout. When stacked upon one another, weights 30 form an elongate continuous channel 67 extending inwardly into each of weights 30. When stacked, weights 30 further define a multitude of cavities or voids 70 between consecutive weights 30. Voids 70 each have a floor defined by an underlying weight 30 and a ceiling defined by an overlying weight 30. In one embodiment, voids 70 are formed by intermediate spacers (not shown) positioned between weights 30. In another embodiment, such voids 70 are formed by cavities, depressions, recesses and the like directly formed in one or both of opposing faces of consecutive weights 30. Channel 67 and voids 70 facilitate selection of one or more weights 30 by media weight selection system 34.

Main weight selection system 34 comprises a mechanism configured to permit a person to select one or more of weights 30 for lifting during an exercise. Main weight selection system 34 includes a selector 82 configured to be linearly translated up and down along weights 30 and partially within channel 67 in the direction indicated by arrows 39 to a position horizontally across from or just below a desired lowermost weight 30 to be lifted along with all overlying weights 30. Selector 82 is configured to be moved between a first position in which selector 82 is inserted into or projects into at least one of voids 70 below a selected lowermost weight to couple the lowermost weight to weight lift 35 and a second position and which selector 82 is withdrawn from any void 70 and his movable along and within channel 67.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Overall, because main weight selection system 34 moves within channel 67 and selectively engages weights by being moved into and out of intermediate voids 70 defined by such weights 30, easier selection of weights 30 is facilitated and the cost of weight system 22 is reduced. Because main weight selection system 34 utilize a selector 82 that is movable between an inserted position and a withdrawn position with respect to a desired void 70, weight system 22 does not utilize the insertion of a pin into a cross-drilled bore in a weight. As a result, selection of a particular weight is easier. In addition, weights 30 may omit cross-drilled holes, reducing the number of manufacturing steps and lessening fabrication cost. In addition, because weights 30 may omit such cross drilled holes, weights 30 are more structurally durable. As a result, weights 30 may be formed from alternative, less expensive materials which may not need to withstand such multiple machining steps.

Weight lift 35 comprises a structure coupled to main weight selection system 34 which is connected to cable system 24. In one embodiment, weight lift 35 may itself comprise a cable. For purposes of this disclosure, the term "cable" shall encompass any flexible member, including but not limited to cables, belts, ropes, chains, bands, straps, pivotably connected linkages and the like. Weight lift 35 may also be coupled to an incremental weight 36 by incremental weight selection system 38.

Incremental weights 36 comprise structures or members having a predetermined weight amount that are configured to be selectively coupled to weight lift 35 by incremental weight selection system 38. In one embodiment, incremental weights 36 each have a weight amount less than a predetermined weight amount of each of main weights 30. For example, in one embodiment, each of main weights 30 may be 15 pounds while each of incremental weights 36 is 5 pounds. In another embodiment, each of main weights 30 may be 10 pounds while each of incremental weights 36 is 5 pounds. In one embodiment, incremental weights 36 may include a 5 pound incremental weight and a 2.5 pound incremental weight. Incremental weights 36 permit a person to select a total amount of weight for an exercise that is intermediate or between the larger weight increments provided by main weights 30.

As schematically represented in FIG. 1, incremental weights 36 longitudinally extend across multiple weights 30. As a result, incremental weights 36 do not increase the overall height of weight system 22. In one embodiment, incremental weights 36 comprise rods or bars passing through openings within weights 30 or contained within cutouts along a face of the stack of weights 30. As a result, incremental weights 36 are more closely positioned relative to a center of mass of the weight stack. Consequently, tipping moments of the stack which could cause friction with the guide rods or other structures that guide movement of the stack are reduced. In yet another embodiment, incremental weights 36 may extend external to the stack of weights 30.

Incremental weight selection system 38 comprises a mechanism configured to selectively add or remove incremental weights 36 from the total amount of weight connected to weight lift 35. In one embodiment, incremental weight selection system 38 rotates between various positions in which a selected one of supplemental weights 36 are selectively connected to weight lift 35. For example, in one embodiment, incremental weight selection system 38 may rotate to a first position in which a first incremental weight is connected to weight lift 35, a second position in which a second incremental weight is additionally connected to weight lift 35 and a third position in which neither the first incremental weight nor the second incremental weight are connected to weight lift 35. In other embodiments, incremental weight selection system 38 may have other configurations. In still other embodiments, incremental weight 36 and incremental weight selection system 38 may be omitted.

Cable system 24 comprises a system of pulleys and cables configured to operably coupled weight lift 35 (and any connected weights 30, 36) to exercise interface 26. Cable system 24 may have any of a variety of different sizes, shapes and configurations depending upon exercise interface 26. In other embodiments, exercise interface 26 may be operably coupled to weight system 22 by other mechanisms.

Exercise interface 26 comprises a device or mechanism operably coupled to cable system 24 by which one or more persons may exert force against one or more structures and may move the one or more structures to raise or lift a selected amount of weight provided by weights 30 and/or 36. Exercise interface 26 may have various configurations depending upon which particular muscles or groups of muscles are to be exercised. Examples of exercise interface 26 include, but are not limited to the following types of exercise machines: abdominal isolator, angled seated calf, abductor, seated leg curl, glute isolator, vertical and horizontal, rear delt/pec fly, lateral raise, shoulder press, vertical press, back extension, seated row, vertical row, pulldown, long pull, seated dip, seated tricep extension, bicep curl, camber curl and bench press. Exercise interface 26 may be provided as part of a multi-station exercise machine, a modular exercise machine or a single station exercise machine.

Although weight system 22 has been illustrated and described for use as part of an exercise device 20 additionally including cable system 24 and exercise interface 26 (shown and described with respect to FIG. 1), in other embodiments, weight system 22 may be employed in devices other than exercise devices. For example, weight system 22 may alternatively be employed in testing and calibration systems where it may be desirable to apply different weights, loads or impact forces by selecting one or more weights and by sensing or taking measurements or readings. In such alternative applications, weight system 22 provides a low-cost and simple to use and adjust weights system.

Figure 2:
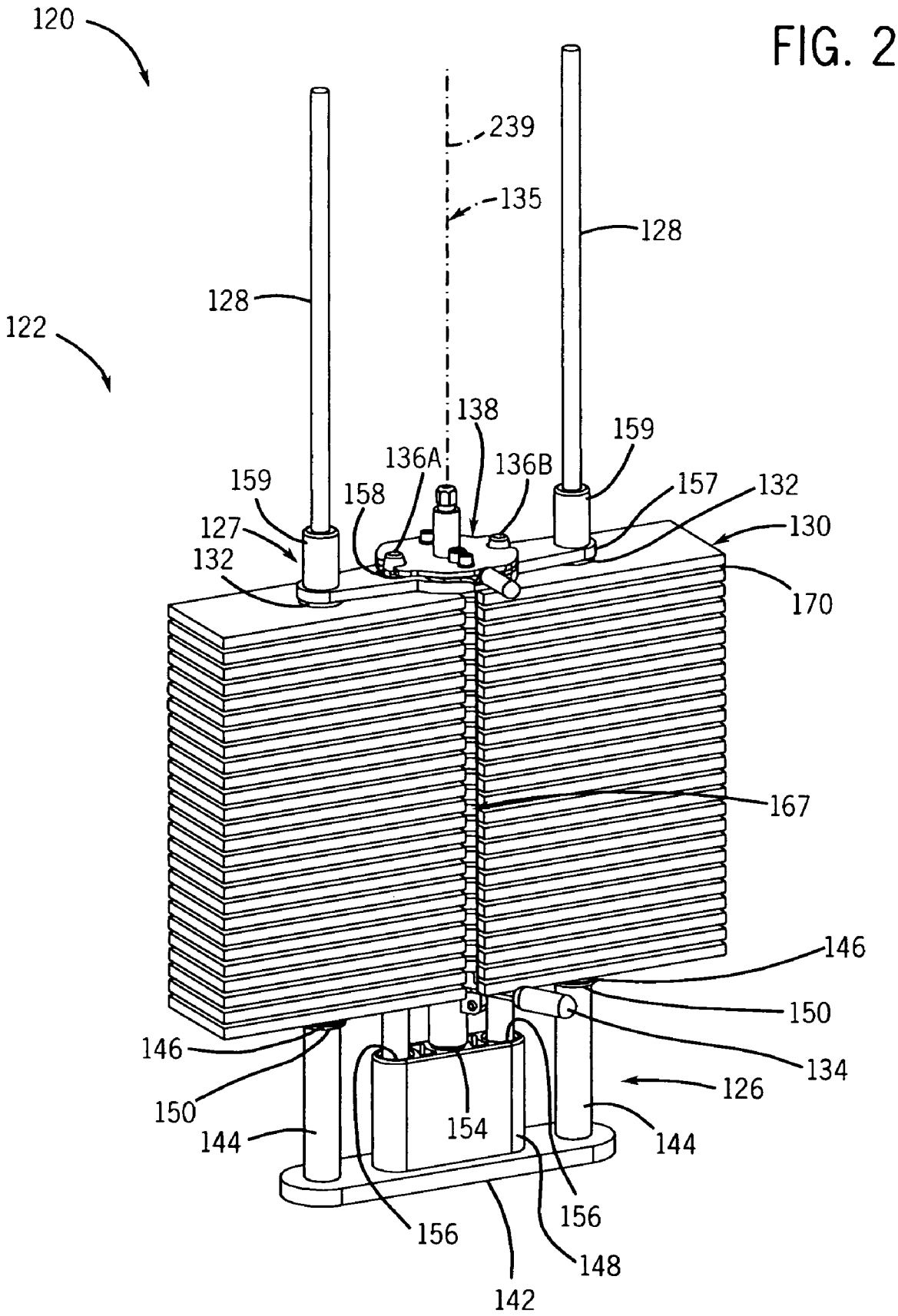
FIG. 2 is a perspective view of another embodiment of the weight system of FIG. 1 according to an example embodiment.
Figure 3:
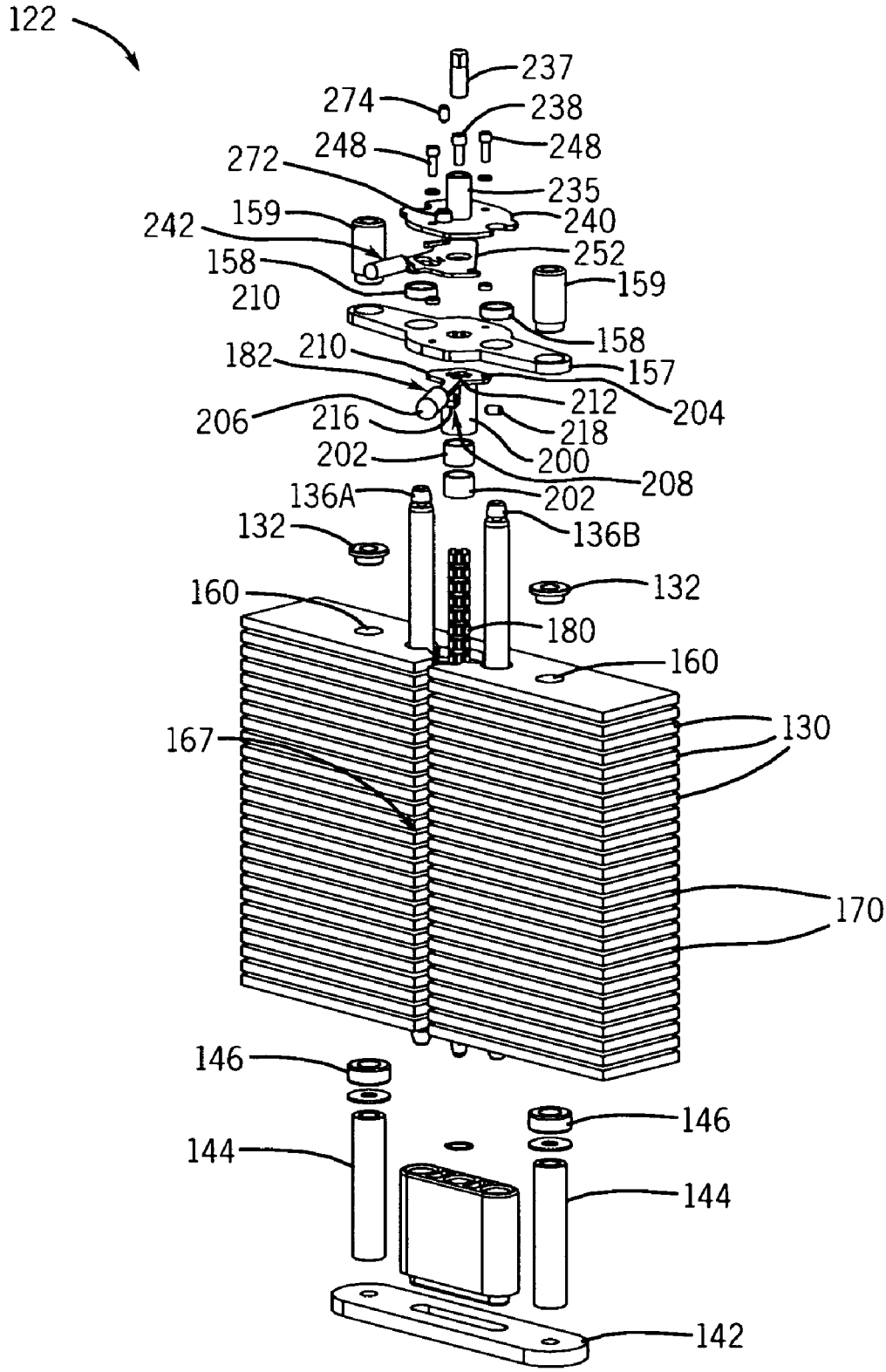
FIG. 3 is an exploded perspective view of the weight system of FIG. 2 according to an example embodiment.

FIGS. 2 and 3 illustrate exercise device 120, another embodiment of exercise device 20 (shown in FIG. 1). Like device 20, device 120 also includes cable system 24 and exercise interface 26 (both of which are shown and described with respect to device 20). Unlike device 20, device 120 includes weight system 122, a specific embodiment of weight system 22. FIG. 2 is a perspective view of exercise device 120 and weight system 122. FIG. 3 is an exploded perspective view of exercise device 120 and weight system 122. As will be described hereafter, weight system 122 is a relatively low-cost arrangement of components which enables a person to quickly and easily select a desired amount of weight for an exercise routine.

Weight system 122 generally includes base 126, upper guide 127, guide rods 128, weights 130, spacers 132 (shown in FIG. 3), main weight selection system 134, weight lift 135, incremental weights 136A, 136B (collectively referred to as incremental weights 136) and incremental weight selection system 138. Base 126 comprises an arrangement of components configured to serve as a foundation and support for weight system 122. Base 126 includes foot 142, risers 144, bumpers 146 and dock 148. Foot 142 supports risers 144 and dock 148. Although foot 142 is illustrated as a plate, in other embodiments, foot 142 may have other configurations.

Bumpers 146 comprise resiliently compressible members positioned between risers 144 and weights 130. In the example illustrated, additional washers 150 are disposed between risers 144 and bumpers 146. Bumpers 146 are configured to absorb the impact of weights 130 as weights 130 are dropped or otherwise lowered. In the example embodiment illustrated, bumpers and 146 are each formed from a bulk or mass of rubber. In other embodiments, bumpers and 146 may be formed from other resiliently compressible materials or may include other resiliently compressible members, such as one or more springs. In still other embodiments, bumpers 146 or risers 144 may be omitted.

Dock 148 comprises one or more members configured to remotely receive, support and guide portions of main weight selection system 134 and incremental weights 136. Dock 148 extends from foot 142 and includes main bore 154 and incremental weight bores and 156. Main bore 154 comprises an opening configured to remotely and slidably receive a lower portion of main weight selection system 134 when weights 130 are not being lifted. As will be described in more detail hereafter, main bore 154 appropriately aligns portions of main weight selection system 134 with weights 130 such that weights 130 may be selectively engaged by main weight selection system 134. Likewise, incremental weight bores 156 comprise openings configured to remotely and slidably receive lower ends of the incremental weights 136. As will be described in more detail hereafter, incremental weight bores 156 support incremental weights 136 with respect to incremental weight selection system 138 such that incremental weights 136 may be selectively engaged by incremental weight selection system 138. Although dock 148 is illustrated as a single unitary or integral structure providing each of bores 154 and 156, in other embodiments, dock 148 may alternatively comprise distinct individual tubes or structures extending from foot 142.

Upper guide 127 comprises an arrangement of structures or components located on an opposite end of the stack of weights 130 as base 126 that is configured to assist in guiding movement of weights 130 along guide rods 128. Upper guide 127 includes top plate 157, incremental weight alignment bushings 158 and guide rod bushings 159. Top plate 157 serves as a cap for the stack of weights 130. Top plate 157 supports remaining components of upper guide 127. In the particular example illustrated, top plate 157 further supports incremental weight selection system 138. In other embodiments, or guide 127 may be provided at other locations or may be omitted.

Incremental weight alignment bushings 158 extend within apertures in top plate 157 and receive an upper portion of incremental weights 136. Guide rod bushings 159 slidably receive the guide rods 128 and guide movement of weights 130 along guide rods 128. In particular embodiments, such bushings may be omitted.

Guide rods 128 comprise elongate structures extending from foot 142 through weights 130. Guide rods 128 additionally extend through risers 144 and bumpers 146 and may extend to an upper frame structure (not shown) of exercise device 120. Guide rods 128 are configured to orient weights 130 and guide movement of weights 130 as they are being lifted or lowered. In particular embodiments, guide rods 128 may have other configurations or may be omitted.

Figure 4:
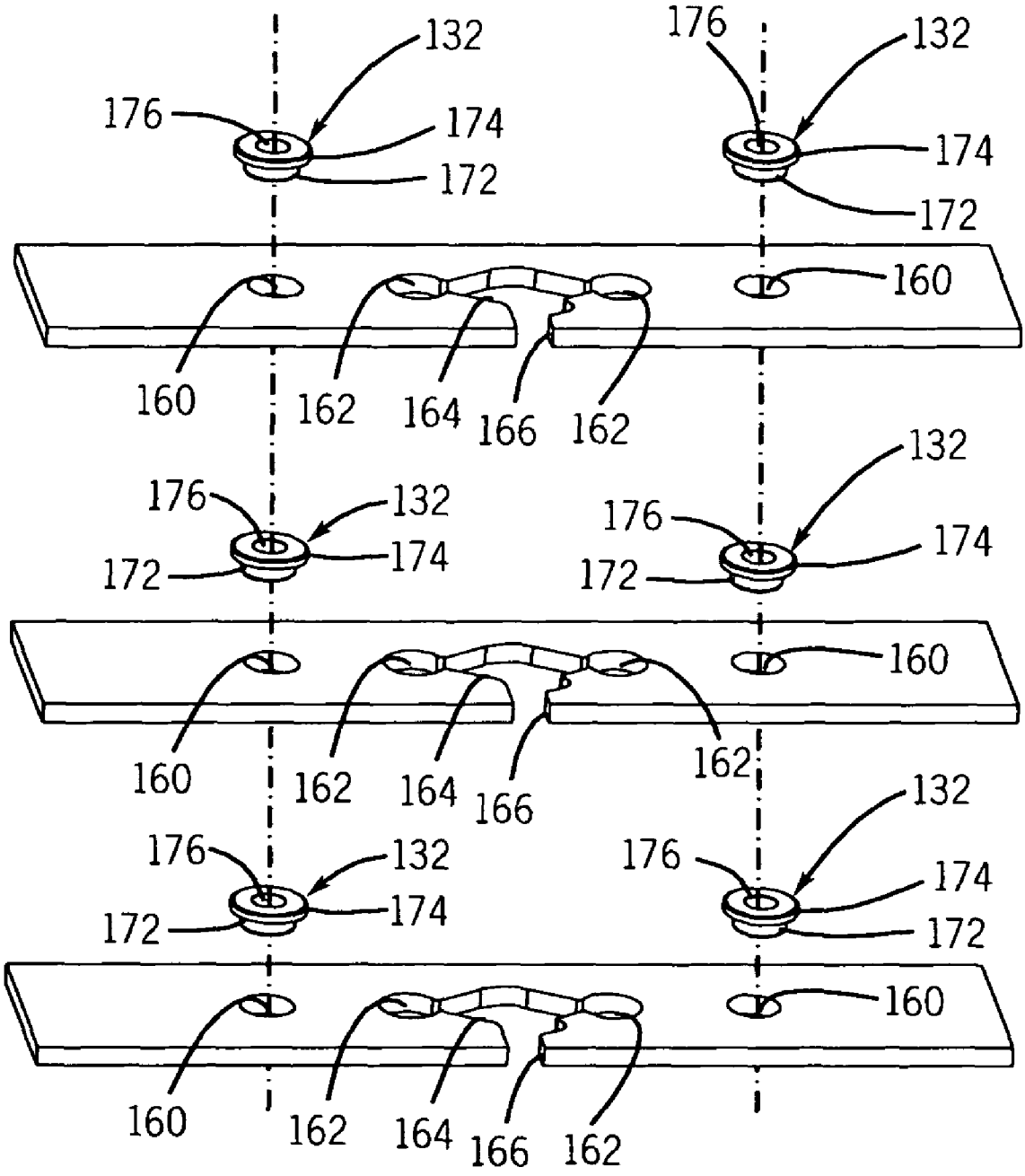
FIG. 4 is an exploded perspective view of weights and spacers of the weight system of FIG. 2 according to an example embodiment.

Weights 130 comprise structures having predetermined weight amounts which are configured to be lifted and to provide a mechanical resistance in an exercise. In the particular example illustrated, weights 130 each comprise a solid or hollow plate of one or more metals. In other embodiments, weights 130 may comprise other materials or may comprise encapsulated materials, such as sand, water or other materials. Weights 130 are stacked upon one another such that as a particular weight 130 is being lifted other weights 130 stacked upon the particular weight 130 are also lifted. FIG. 4 is an exploded view of three consecutively stacked weights 130. As shown by FIG. 4, each weight 130 includes guide rod openings 160, incremental weight apertures 162, selector aperture 164 and access channel 166. Guide rod openings 160 comprise bores passages extending through weight 130. Openings 160 of weight 130 are further configured to align with one another when weights 130 are stacked upon one another. Openings 160 are configured to receive guide rods 128.

Incremental weight apertures 162 comprise bores or openings through which incremental weights 136 extend. Apertures 162 are configured to be aligned with one another when weights 130 are stacked upon one another. Incremental weight apertures 162 generally direct upward or downward movement of the incremental weights 136 when incremental weights 136 are being lifted or lowered.

Although incremental weight apertures 162 are illustrated as being connected to and in communication with selector aperture 164, in other embodiments, incremental weight apertures 162 may be completely bordered or surrounded by weight 130 or may be provided in other locations. In embodiments where weight system 122 includes a greater or fewer of such incremental weights 136, each weight 130 may also include a corresponding fewer or greater of such incremental weight apertures 162. In particular embodiments where incremental weights 136 extend across multiple weights 130 outside or beyond an outer perimeter of weights 130, incremental weight apertures 162 may be omitted or may alternatively comprise an inwardly extending cut out along the perimeter of each weight 130.

Selector aperture 164 comprises an opening extending through weights 130 and configured to receive portions of main weight selection system 134. Selector apertures 164 are configured to be aligned with one another when weights 130 are stacked upon one another. As will be described in more detail hereafter, apertures 164 are configured such that when a portion weight selection system 134 is aligned with apertures 164, that portion of the weight selection system 134 may move through aperture 164 along and across weights 130. When that portion of weight selection system 134 is moved so as to be out of alignment with apertures 164, that portion of weight selection system 134 extends into a void formed between consecutive weights 130 such that all weights 130 overlying that portion of weight selection system 134 may be lifted.

Access channel 166 comprises an opening or passage extending from a perimeter or edge of each weight 130 inwardly to selector aperture 164. Access channel 166 extends generally perpendicular to a longitudinal axis along which weights 130 are stacked and along which each of openings 160, aperture 162 and aperture 164 extend or are aligned. Access channel 166 is configured to permit portions of main weight selection system 134 to project from selector aperture 164 to a location in front of weights 134 for access and manipulation by a person. Access channels 166 aligned with one another, permitting a person to grasp portions of main weight selection system 134 and to move main weight selection system 134 vertically upward and downward through and along a continuous vertical channel 67 formed by the individual access channels 166. As a result, access channel 166 permits a person to move main weight selection system 134 to one of a plurality of available positions along the stack of weights 130 to select a total number of weights 130 or a total weight amount to be lifted.

Spacers 132 comprise one or more structures disposed between weights 130 that are configured to space and separate consecutive or adjacent weights from one another in the vertical direction so as to form voids 170 between consecutive weights 130. As shown by FIG. 3, in the particular example illustrated, spacers 132 comprise annular bushings having a lower cylindrical portion 172, an annular rim 174 and a through opening 176. When positioned between consecutive weights 130, cylindrical portion 172 of spacer 132 extends into opening 160 of an underlying weight 130, rim 174 forms a shoulder bearing against a top of the underlying weight 130 and an overlying weight 33, spacing the overlying weight 130 from the top of the underlying weight 130. Rim 174 spaces consecutive weights by a vertical distance such that the void as a height greater than or equal to that portion of main weight selection system 134 that is received within the void. At the same time, through holes 176 permits one of guide rods 128 to pass through weight 130, facilitating slidable movement of weights 130 along guide rods 128. Thus, such bushings serve a dual purpose.

In other embodiments, spacers 132 may be provided separately from the bushings that facilitate sliding movement of weights 130 along the guide rods 128. For example, the bushings shown in FIG. 3 may alternatively omit rim 174 and extend within openings 160. In particular embodiments, spacer 132 may comprise washers disposed about guide rods 128 been captured between weights 130. Separate structures may be mounted to the upper surface, lower surface or both the surfaces of each weight 130. In particular embodiments, spacer 132 may be fastened, glued, bonded or welded to one or more sources of weight 130. And yet other embodiments, spacer 132 may be integrally formed as part of a single unitary body with weight 130. For example, in embodiments where weight 130 comprises a casting of one or more metals, spacer 132 may be cast along with weight 130. In embodiments where weight 130 comprises an encapsulated material, weight 130 may be molded or otherwise formed in the encasement skin.

Although spacers 132 are utilized in the particular example illustrated to form spaces or voids 170 between consecutive weights 130 that extend substantially across an entirety (less the space occupied by spacers 132) of a face of each of the consecutive weights 130, in other embodiments, spaces or voids 170 may be provided in other fashions and may have other surface extents. For example, in another embodiment, voids 170, which are used to receive a portion of weight selection system 134, may alternatively comprise a recess, depression or cavity formed or otherwise provided within either the upper surface, the lower surface or both of such surfaces of each weight 130. In such an embodiment, a majority of either the upper face or the lower face may be in direct contact with the lower face or the upper face, respectively, of a consecutive weight 130, wherein only the floor or the roof of such recesses of consecutive weights are spaced from one another to form the void.

Main weight selection system 134 comprises a mechanism configured to permit a person to select one or more of weights 130 for lifting during an exercise. Main weight selection system 134 includes selector stem 180 and main selector 182. Selector stem 180 comprises an elongate shaft, bar, rod or other structure coupled to weight lift 135 and movably positioned within selector apertures 164 of weights 130 such that stem 180 may be raised or lowered by weight lift 135. In the particular example illustrated, stem 180 is coupled to weight lift 135 by incremental weight selection system 138. As a result, even when no weights 130 are selected, stem 180 and incremental weight selection system 138 provide an initial weight. Stem 180 extends along an axis 183 (shown in FIG. 5) and is configured to slidably support main selector 182 along an axis 183. Selector stem 180 is configured such that selector 182 may be retained relative to stem 180 at a selected one on a plurality of positions along an axis 183 such that selector 182, and any engaged weights 130, will move with movement of stem 180 by weight lift 135.

Figure 5:
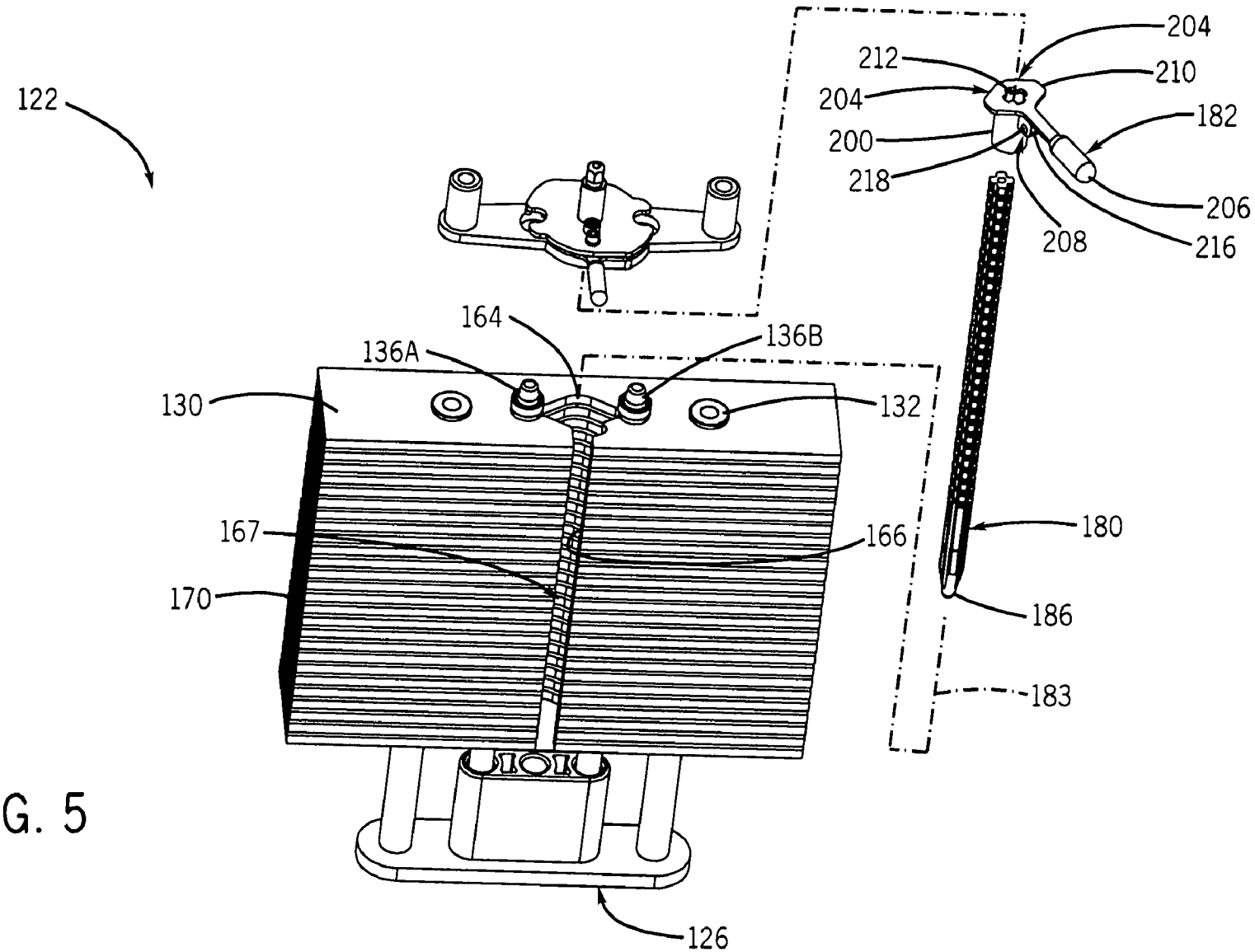
FIG. 5 is a partially exploded perspective view of the weight system of FIG. 2 illustrating a stem and a selector according to an example embodiment.
Figure 6:
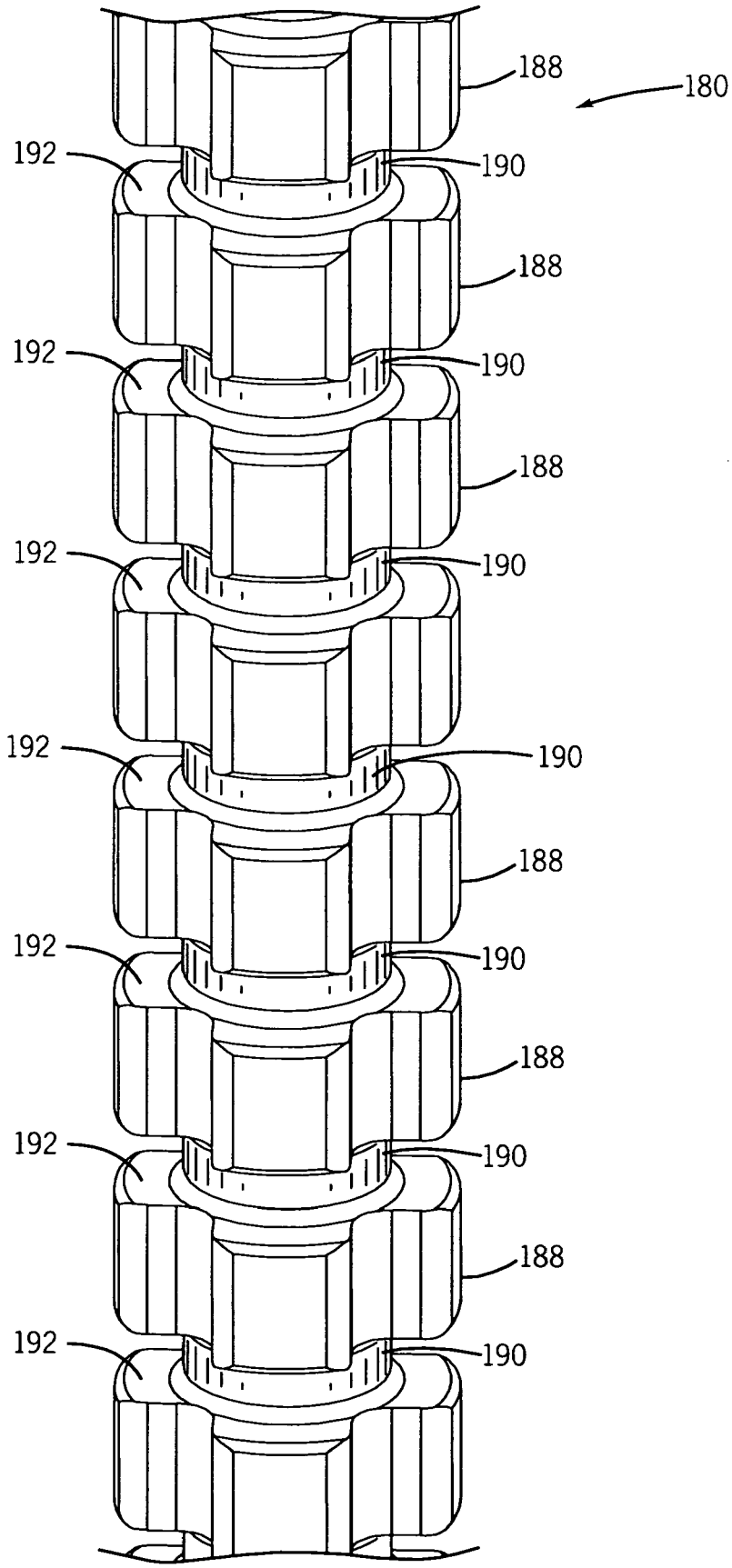
FIG. 6 is an enlarged fragmentary view of a portion of the stem of FIG. 5 according to an example embodiment.

FIG. 5 illustrates stem 180 in full while FIG. 6 is an enlarged view of stem 180. As shown by FIGS. 5 and 6, stem 180 includes a tapered end portion 186 and a multitude of segments 188 joined and spaced apart from one another by spacers 190. End portion 186 is configured to be removably received within bore 154. End portion 186 generally tapers towards a point along axis 183. In one embodiment, end portion 186 is at least partially conical. Because end portion 186 is tapered, end portion 186 self centers and aligns itself as it is being lowered into bore 154. Because end portion 186 aligns itself into bore 154, other structures or mechanisms otherwise used to provide and precise control over positioning of stem 180 when it is withdrawn from bore 154 when weights 130 are being lifted may be omitted or may be provided with greater tolerances, potentially reducing friction and drag as weights 130 are being lifted to provide a smoother feel. In addition, because end portion 186 aligns itself into bore 154, part tolerances may be increased, reducing cost. For example, because end portion 186 is tapered and self aligning, guide rods 128 and not necessarily have to maintain precise positional control over stem 180 or both portions at the top of weight system 122 connected to stem 180, such as incremental weight selection system 138. As a result, the spacing or gap between guide rods 128 and bushings at an upper end of weight system 122 may be increased, reducing friction providing a smoother lifting of weights 130.

Although tapered end portion 186 is illustrated as being employed with stem 180 which includes segments 188 and spacers 190, tapered end portion 186 may alternatively be employed in other stems or lifting rods which are selectively connected to weights in a stack in an exercise device. For example, tapered end portion 186 may also be employed in other presently available weight stacks having a central rod or shaft with multiple axially holes that receive a pin that is inserted through corresponding through holes in individual weight plates. In other embodiments, tapered end portion 186 may be semi-bulbous or semi-spherical in shape, may be flat or may be omitted.

Segments 188 and spacers 190 alternately extend along axis 183. Each segment 188 is shaped such that selector 182 may be rotated about axis 83 between a first angular position in selector 182 may be moved or slid along axis 83 without substantial interference from segments 188 and a second angular position in which selector 182 is retained between two consecutive segments 188 along axis 183. In particular, segment 188 has a cross-sectional shape configured such that each segment 188 may pass through an opening in selector 182 when selector 182 is in a first angular position and is obstructed so as to not pass through the same opening in selector 182 when selector 182 is in the second angular position. In the example illustrated, each of the segments 188 has a non-circular or non-annular cross-sectional shape. In the particular example illustrated, each of the segments 188 as a non-circular cross-sectional shape which corresponds to a cross-sectional shape of the opening through main selector 182. In the example illustrated, each segment 188 has a generally "+" shaped cross-section. As a result, a segment 188 extends below a larger portion of selector 182 to provide enhanced retention of selector 182 such that weights 130 are better connected to stem 180. In other embodiments, segment 188 may have other cross-sectional shapes.

Each segment 188 further has a height or thickness substantially equal to a height or thickness of an individual weight 130 extending horizontally across from the particular segment 188. As a result, the gaps 192 provided by spacers 190 are in substantial vertical alignment (horizontally across from) void 170 between weights 130. In the particular example illustrated in which each weight 130 has substantially the same thickness, each of segments 188 also has substantially the same thickness. In other embodiments in which different weights 130 may have different thicknesses, segment 188 may also have different thicknesses so long as each segment 188 has a thickness with substantially equal to the thickness of the particular weight 130 horizontally across from the particular segment 188.

Spacers 190 comprise portions of stem 180 which extend between segments 188 to separate segments 188. Spacers 190 each have a height such that a portion of selector 182 may be captured or received between consecutive segments 188. Each spacer 190 is configured to support and overlying segment 188 such as a top of the segment is substantially horizontally coplanar or coextensive with before of a corresponding void 170 (shown in FIG. 2). According to one embodiment, spacers 190 each have a height substantially equal to a height of a corresponding void 170 (shown in FIG. 2). In the particular example illustrated, each spacer 190 has a height substantially equal to a height of rim 174 of spacer 132 (shown in FIG. 4). Spacers 190 permit selector 182 to rotate between the first and second angular positions. Spacers 190 each have a cross-sectional shape dimension smaller than a cross-sectional shape of segments 188.

In the particular example illustrated, each spacer 190 has a circular cross-sectional shape, facilitating easier rotation of selector 182 when between consecutive segments 188. In other embodiments, spacers 190 may have other cross-sectional shapes. In the example illustrated, each spacer is integrally formed as a single unitary body with other spacers 190 and with segments 188. In other embodiments, one or more of spacers 190 or one or more of segments 188 may be independent or distinct structures connected to one another, stacked upon one another or connected to a third supporting structure, such as a support shaft, rod or bar.

Selector 182 comprises a mechanism configured to be moved along and at least partially within channel 167 between one of a plurality of multiple selectable positions across from a selected void 170 and to be moved from a withdrawn position to an inserted position in which selector 182 extends between the void and is axially retained relative to stem 180. As a result, when weight lift 135 exerts a lifting force upon stem 180 to lift stem 180, selector 182 and any overlying weights 130 are also lifted. In the particular example illustrated, selector 182 is configured to rotate between the inserted position and the withdrawn position.

As shown by FIG. 3, selector 182 includes housing 200, bearings 202, engagement plate 204, handle 206, and alignment indicator 208. Housing 200 comprises a structure configured to house bearings 202 which facilitate sliding movement of selector 182 along stem 180. In the particular example illustrated, bearings 202 comprise J-Series sleeve bushings contained within housing 200. Such an embodiment, housing 200 has an internal cylindrical cavity for receiving such bushings.

Engagement plate 204 comprises a structure secured to housing 200 which includes engagement projections 210 and opening 212. In one embodiment, engagement plate 204 is bonded, welded, fastened or otherwise secured to housing 200. In yet another embodiment, plate 204 is integrally formed as part of a single unitary body with housing 200.

Engagement projections 210 comprise outwardly extending projections having a thickness or height and a length so as to be insertable within voids 170. In the particular example illustrated, engagement projections 210 comprise outwardly projecting tabs angularly spaced from one another by approximately 180 degrees. As a result, rotation of selector 182 about stem 180 in either direction positions at least one of projections 210 within a corresponding void 170. In other embodiments, selector 182 may have a single engagement projection 210 or may include greater than one engagement projections 210. In other embodiments, projections 210 may have other shapes as well.

Opening 212 comprises a non-circular opening through plate 204 and in at least partial alignment with the opening or bore within housing 200 and through bearings 202. Opening 212 is configured such that when selector 182 is in a first angular position or orientation, opening 212 permits stem 180 to pass therethrough, permitting selector 182 to be moved or slid along stem 180. Opening 212 is further configured such that when selector 182 is in a second angular position or orientation, plate 204 is captured between consecutive segments 188 such a selector 182 is retained along stem 180. In the particular example illustrated, opening 212 has a shape corresponding to the cross-sectional shape of segments 188. In the particular example illustrated, opening 212 has a "+" shape. In other embodiments, open 212 may have different shapes and may have shapes distinct from the shape of segments 188.

Handle 206 comprises an extension extending from a first location proximate to housing 200 opening 212 within selector apertures 164 of weights and through access channels 166 of weights 130. Handle 206 is configured to be manually grasped by a person, permitting a person to rotate opening 212 between the first angular position which opening 212 is in alignment with segments 188 of stem 180 and a second angular position in which opening 212 is out of alignment with segments 188 of stem 180. Handle 206 further permits a person to manually raise or lower selector 182 along channel 167 when opening 212 has been rotated into alignment with segments 188. In the particular example illustrated, substantial portion of handle 206 are integrally formed as part of a single unitary body with plate 204, reducing fabrication and assembly costs. In other embodiments, handle 206 makes and from housing 200 and may have other shapes and configurations. In still other embodiments, handle 206 may be coupled to a powered actuator configured to selectively rotate handle 206 and opening 212 between the first and second angular positions. In one embodiment, exercise device 120 may include a remote control, such as a wired or wireless remote control, for controlling the actuator and for remotely controlling selector 182.

Alignment indicator 208 comprises a mechanism configured to indicate to a person when engagement projections 210 are in alignment with (horizontally across from) one of voids 170. In the example illustrated, alignment indicator 208 comprises a structure that is resiliently biased in an outward direction from selector 182 into contact with surfaces of weights 130. Alignment indicator 208 extends into an opposite one of voids 171 across from one of voids 170. As selector 182 is raised or lowered and indicator 208 is moved from one of voids 170 to another one of voids 170, alignment indicator 208 resiliently compresses, flexes or otherwise deforms. Alignment indicator 208 provides a clicking sound or a resistance feeling to indicate to a person when selector 182 is in alignment with a selected one of voids 170.

In the particular example illustrated, alignment indicator 208 utilizes a resiliently biased ball. Alignment indicator 208 includes ball detent housing 216 and ball detent 218. Ball detent housing is welded, bonded, fastened otherwise adhered to housing 200 and receives ball detent 218. In the example illustrated, ball detent 218 comprises a ½-13 threaded spring ball detent commercially available from McMaster Carr. In other embodiments, alignment indicator 208 may comprise other resiliently biased surfaces. In other embodiments, alignment indicator 28 may be omitted.

Figure 7:
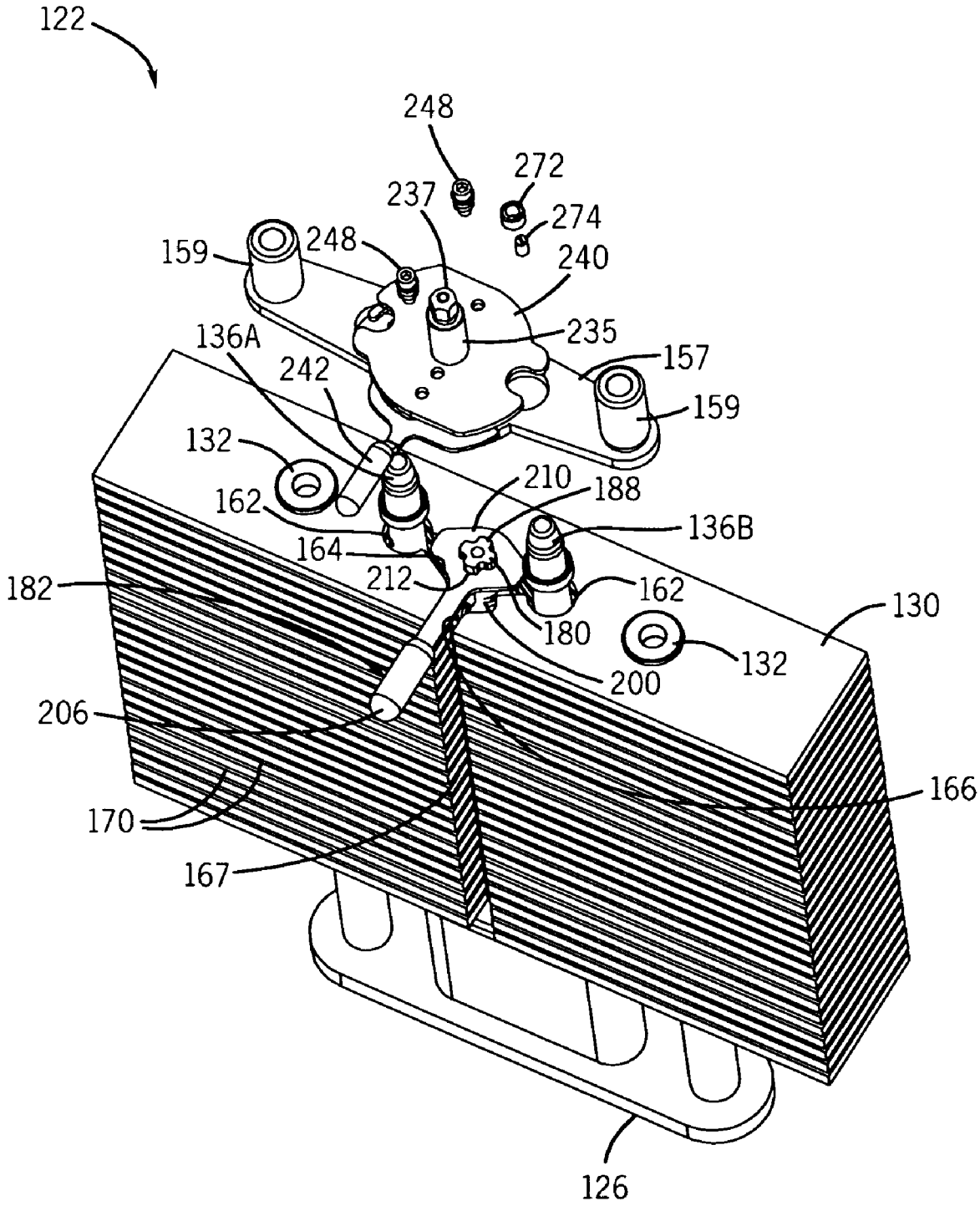
FIG. 7 is a partially exploded top perspective view of the system of FIG. 2 illustrating a selector in an aligned angular position according to an example embodiment.

FIGS. 7-10 illustrate operation of main weight selection system 134. FIG. 7 illustrates selector 182 in the aligned angular position in which opening 212 is sufficiently aligned with segments 188 such that selector 182 may be moved vertically through and along channel 167 to vertically position selector 182 across from one of voids 170. FIG. 7 illustrates selector 182 initially positioned towards an upper one of weights 130.

Figure 8:
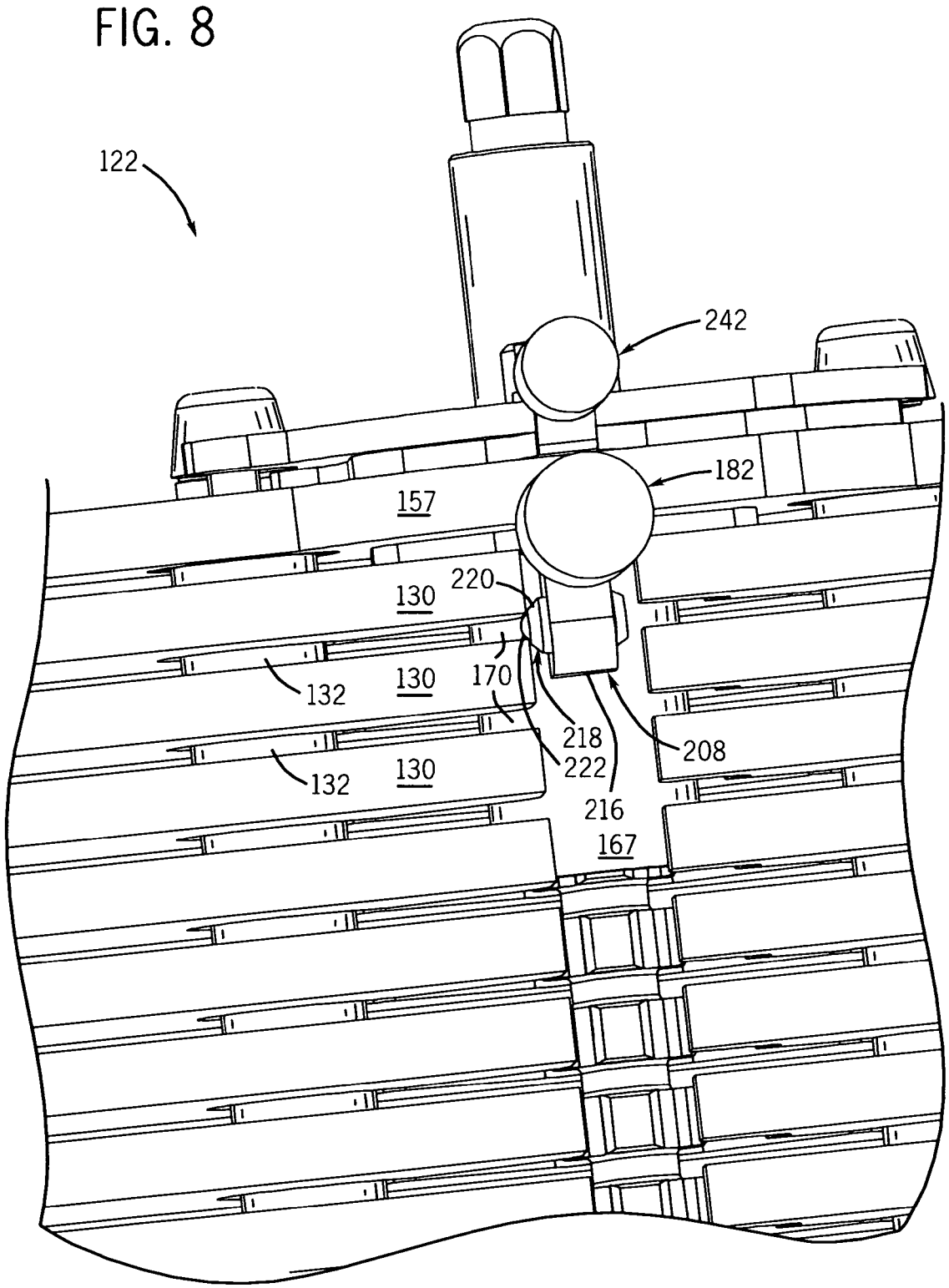
FIG. 8 is an enlarged fragmentary perspective view illustrating a position indicator of the system of FIG. 2 according to an example embodiment.

FIG. 8 illustrates use of alignment indicator 208 in more detail. As shown by FIG. 7, ball detent 218 includes tapered perimeter portions 220 and outwardly projecting resiliently biased ball 222. In the particular example illustrated, ball 222 rotates between a disengaged position which ball 222 is out of engagement with weights 130 (as shown in FIG. 8) and an engaged position in which ball 222 engages edges of weights 130. To receive an indication as to when selector 182 is appropriately aligned with one of voids 170, a person rotates selector 182 to position ball 222 in the engage position. As a result, as selector 182 is raised and lowered, ball 222 alternately projects into a void 170 or is compressed by an intermediate weight 130. This results in the person receiving either an audible or a tactile sensation indicating when selector 182 is in alignment with one of voids 170 and maybe further rotated to a position in which projection 210 may be inserted into one of voids 170.

Figure 9:
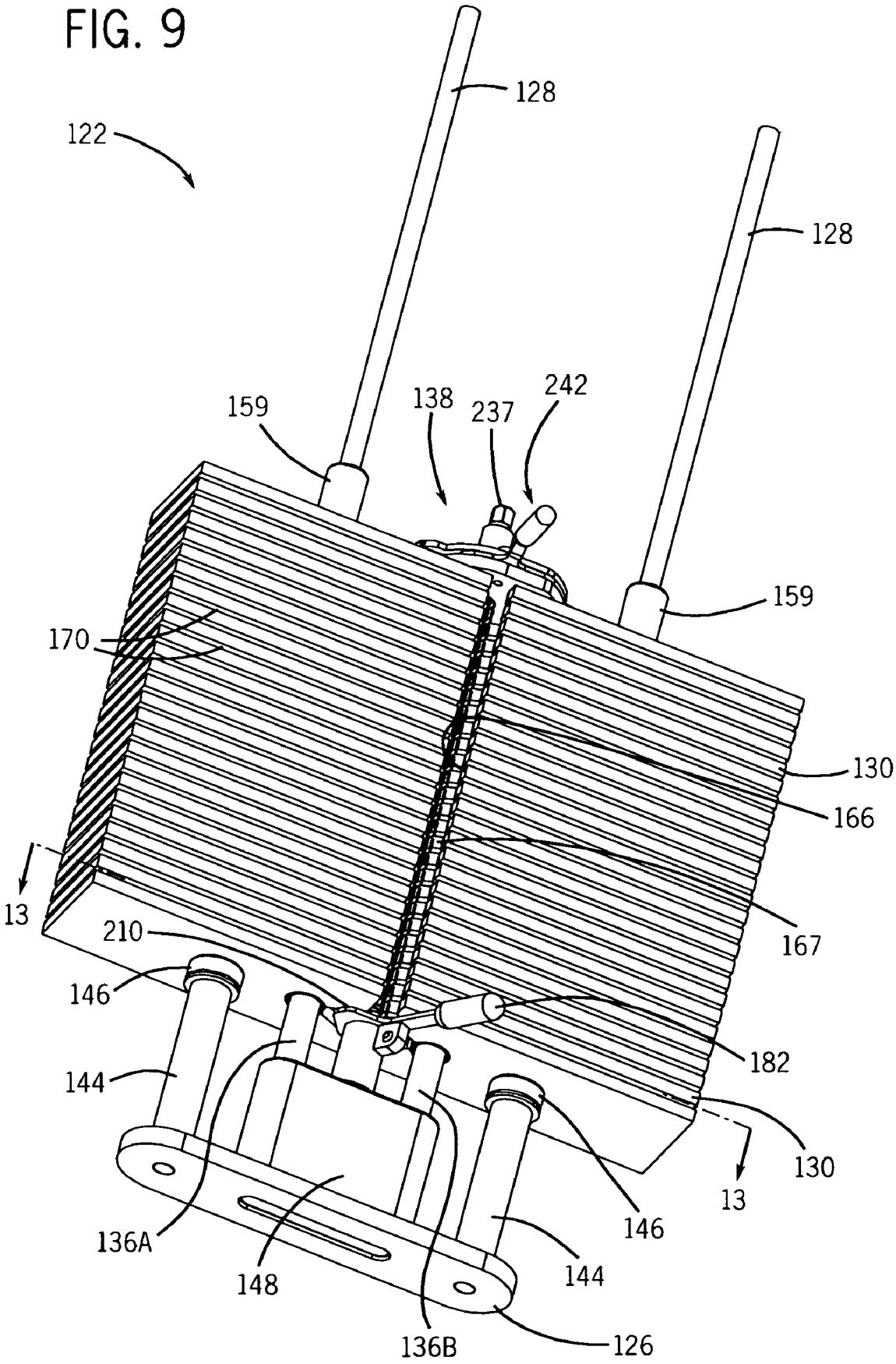
FIG. 9 is a bottom perspective view of the system of FIG. 2 illustrating the selector in a misaligned angular position according to an example embodiment.
Figure 10:
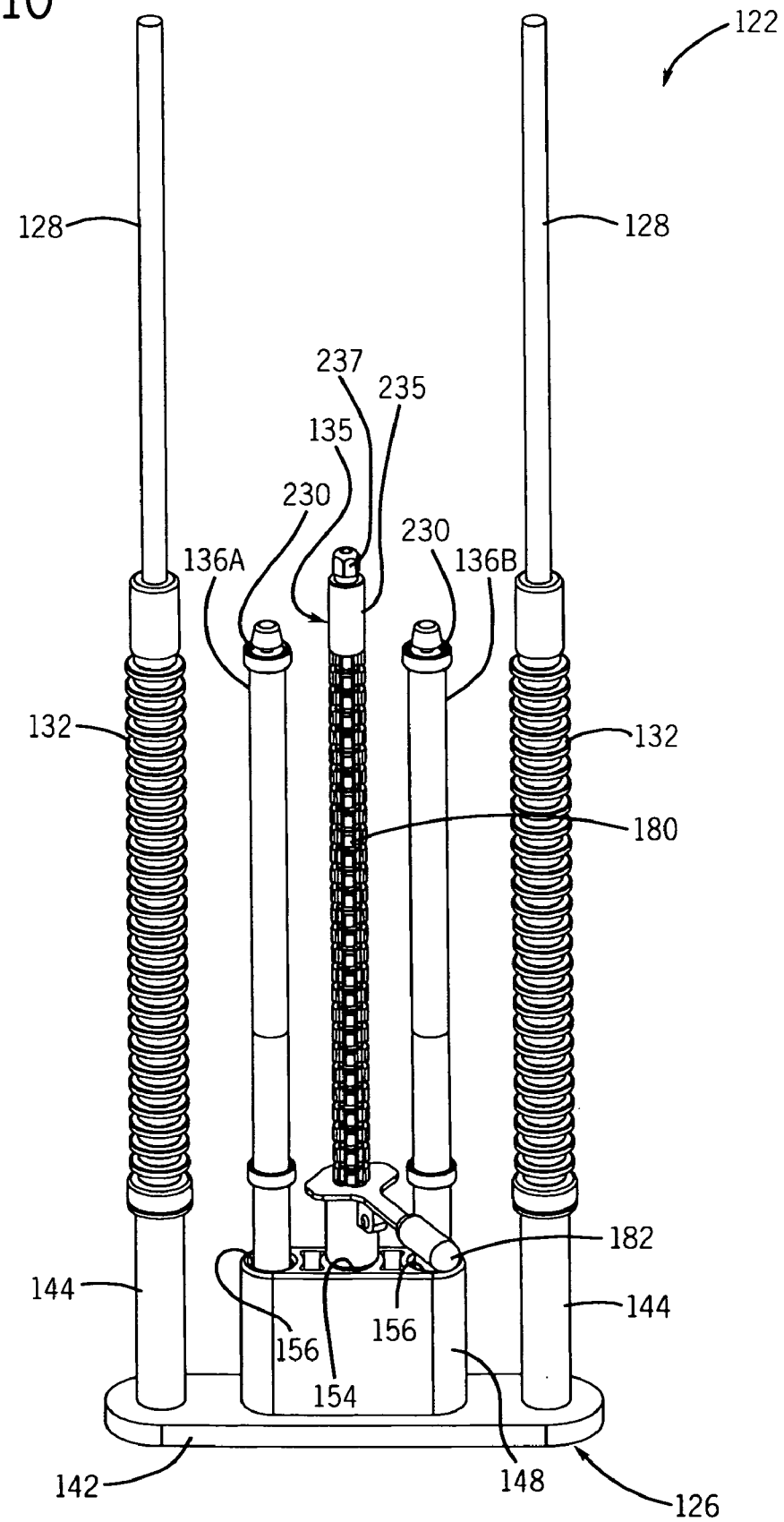
FIG. 10 is a front perspective view of the system of FIG. 9 with portions omitted for purposes of illustration according to an example embodiment.
Figure 10B:
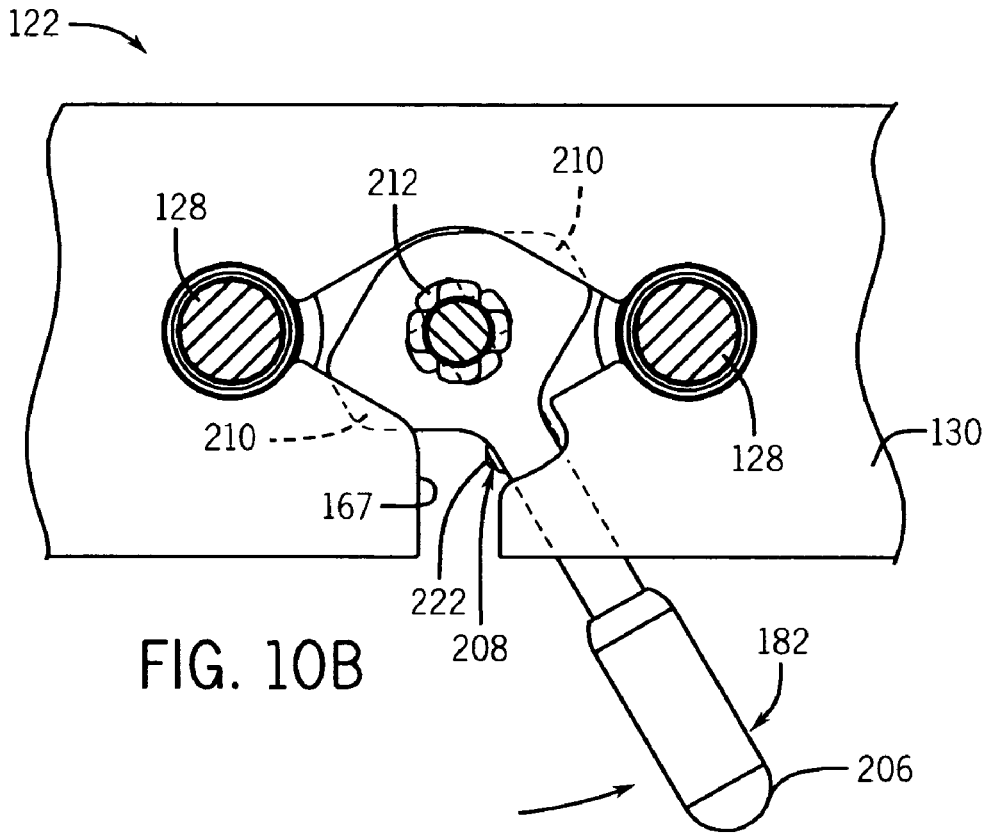
FIG. 10B is a fragmentary top sectional view of a selector of the system of FIG. 9 in an aligned movable position according to an example embodiment.
Figure 10A:
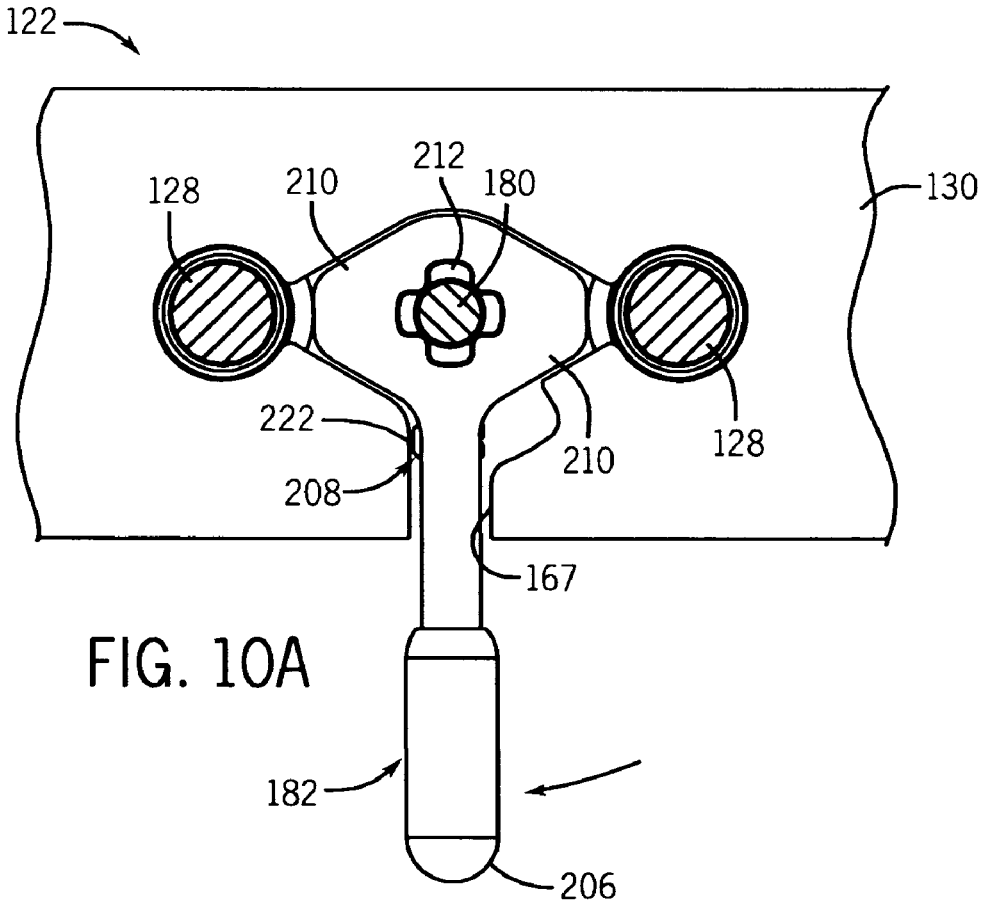
FIG. 10A is a fragmentary top sectional view of a selector of the system of FIG. 9 in a misaligned weight selected position according to an example embodiment.

FIGS. 9 and 10 illustrate selector 182 repositioned to just below a lower most one of weights 130. As shown by FIG. 9, selector 182 is rotated to an annular position such that engagement projections 210 extend below a face of an overlying weight 130. As shown by FIG. 10, this rotation of selector 182 also results in opening 212 being rotated to a misaligned position with respect to segments 188 of stem 180. As a result, selector 182 is axially retained relative to stem 180. Thereafter, any lifting of stem 180 by weight lift 135 also results in selector 182 and any overlying weights 130 also being raised or lifted. To select a different total weight amount, a person (1) simply rotates selector 182 back to the aligned position (shown in FIG. 10A) and slides selector 182 along channel 167 to position selector 182 across from a selected one of voids 170 and below a selected one of weights 130 and (2) rotates selector 182 to the misaligned angular orientation (shown in FIG. 10B). Thus, weight selection is simplified.

Weight lift 135 couples weight selection system 134 and incremental weights selection system 138 to cable system 24 (shown in FIG. 1). Weight lift 135 includes bar 235, cable attachment 237, fastener 238 (shown in FIG. 3) and cable 239 (shown in FIG. 2). Bar 235 extends through incremental weight selection system 138 and is fixedly coupled to top 157. Cable attachment 237 is secured to bar 235 by fastener 238. In other embodiments, weight selection system 134 may be connected to cable system 24 in other manners.

FIG. 10 illustrates incremental weights 136 in more detail. As shown by FIG. 10, incremental weights 136 comprise elongate rods having a predetermined weight. According to one embodiment, weights 136 have individual weight amounts which are distinct from the individual weight amounts of weights 130. In one embodiment, weights 130 each have a weight of 15 pounds while both incremental weights 136A and 136B have a weight of 5 pounds. In one embodiment, weight 136A may have an incremental weight amount one-half that of weights 130 and weight 136B may have an incremental weight amount one-quarter that of weights 130. For example, in one embodiment, each of weights 130 weighs 10 pounds while incremental weights 136A and 136B weigh 5 pounds and 2.5 pounds, respectively. In still other embodiments, weights 136 may have other weight increments distinct from weights 130.

Incremental weights 136 extend through openings 162 (shown in FIG. 4) in weights 130 so as to extend vertically across multiple weights 130. This results in several advantages. First, weights 136 do not substantially increase the height, width or length of weights system 122. Second, incremental weights 36 are more closely positioned relative to a center of mass of the weight stack, reducing tipping moments of the stack which could otherwise cause friction with the guide rods 128 or other structures that guide movement of the stack. Third, weights 136 remain partially hidden for a cleaner more compact appearance. As for further shown by FIG. 10, weights 136 and a lower end received within bores 156 of the dock 148 and upper ends which include grooves or channels 230 configured to receive portions of incremental weight selection system 138.

Figure 11:
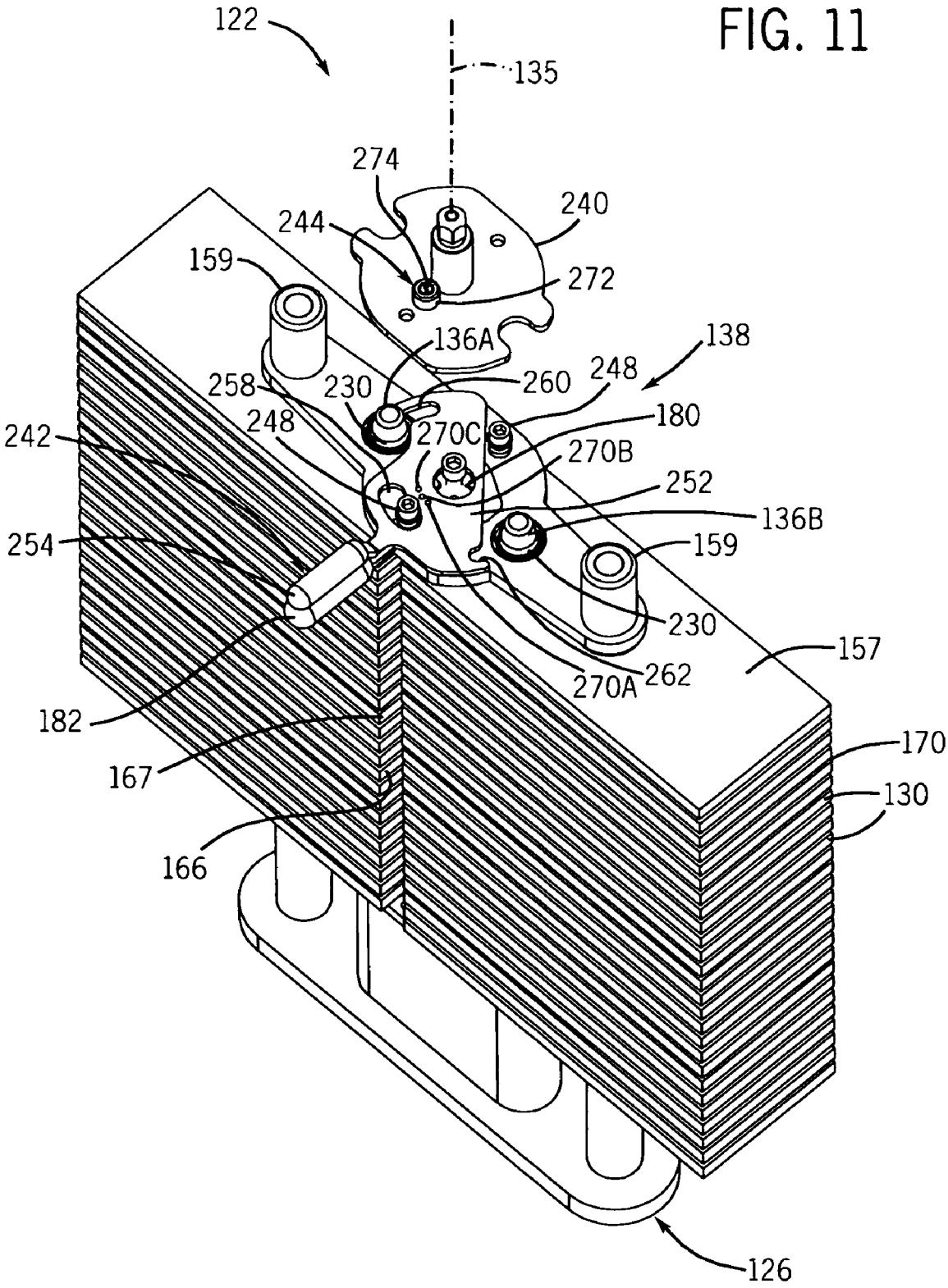
FIG. 11 is a partially exploded top perspective view of the system of FIG. 2 illustrating an incremental weight selection system according to an example embodiment.

FIGS. 3 and 11 illustrate incremental weight selection system 138. Incremental weight selection system 138 is configured to enable a person to select one or both of weights 136 for addition to the total amount of weight largely determined by main weights 130. As shown by FIG. 3, system 138 includes top 240, selector 242 and position indicator 244. Top 240 is mounted to top plate 157 by fasteners 248 so as to capture selector 242 between top 247 and top plate 157. Top 240 further supports portions of position indicator 244. Although illustrated as being circular, top 240 man various shapes and configurations.

Selector 242 comprises a member configured to be rotated about a central axis of stem 180 so as to selectively engage incremental weights 136. Selector 242 includes plate 252 and handle 254. Plate 252 serves as a body for selector 242. Plate 252 includes slot 258, catch 260 and catch 262. Slot 258 comprises an elongate arcuate opening through plate 252 configured to receive fastener 248. Slot 258 guides rotation of selector 242 about the axis of stem 180.

Figure 11A:
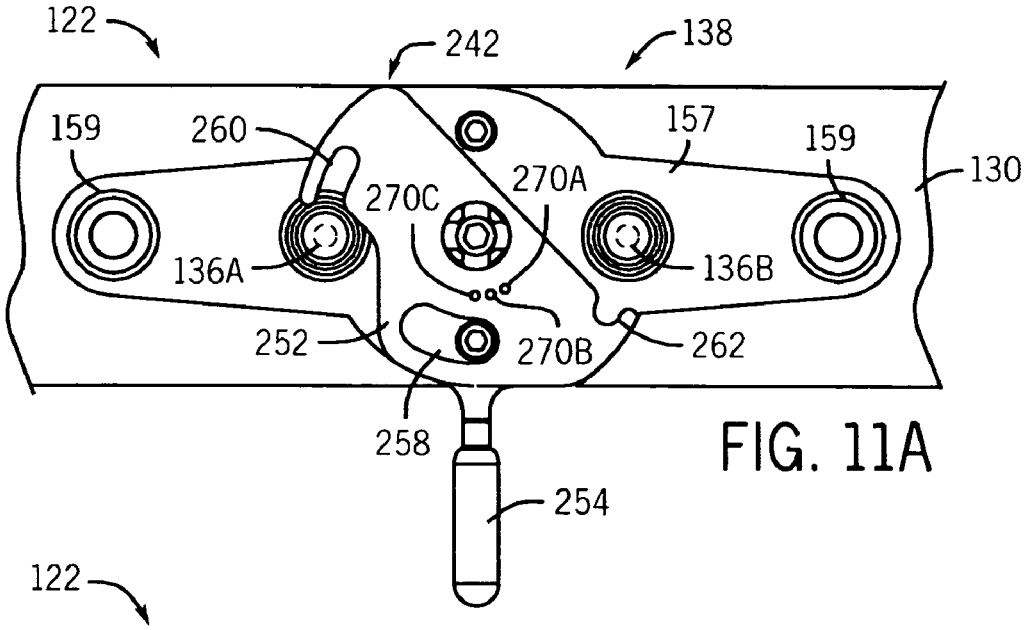
FIG. 11A is a fragmentary top plan view of the system of FIG. 2 illustrating the incremental weight selection system in a first state in which no incremental weights are engaged according to an example embodiment.
Figure 11B:
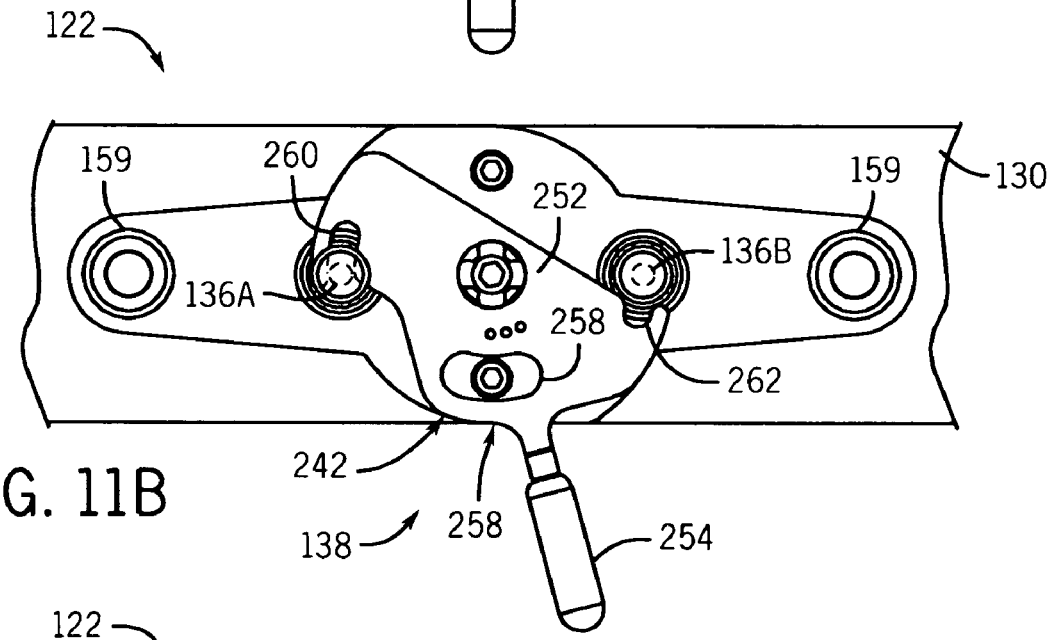
FIG. 11B is a fragmentary top plan view of the system of FIG. 2 illustrating the incremental weight selection system in a second state in which an incremental weight is engaged according to an example embodiment.
Figure 11C:
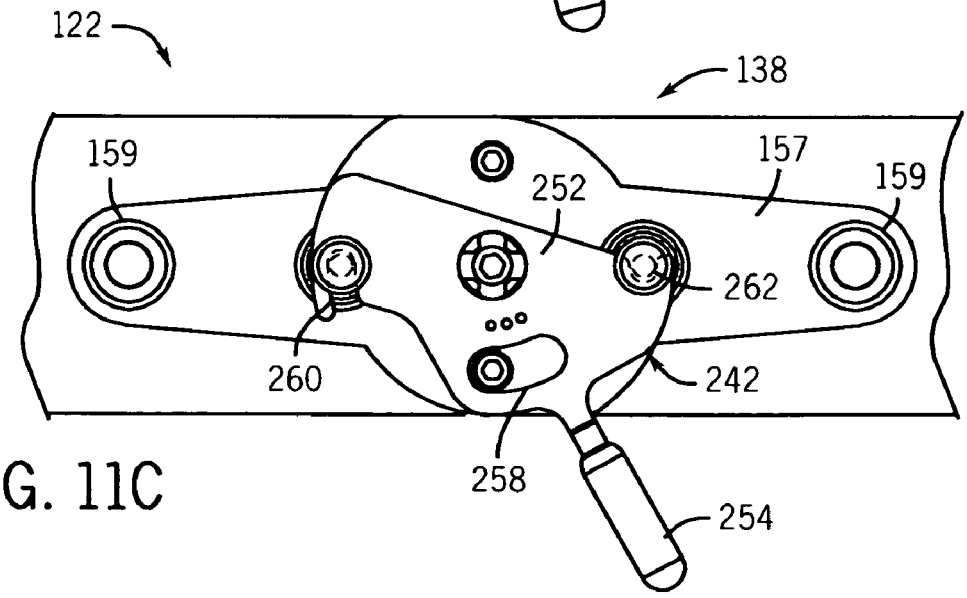
FIG. 11C is a fragmentary top plan view of the system of FIG. 2 illustrating the incremental weight selection system in a third state in which a plurality of incremental weights are engaged according to an example embodiment.

Catches 260 and 262 comprise generally horizontal hooks or notches formed in plate 252 that are configured to receive upper portions of weights 136 such that portions of plate 252 extend about weights 136 within grooves 230. Catches 260 and 262 are angularly located with respect to one another such that: (1) selector 242 may be rotated to a first angular position (shown in FIGS. 11 and 11A) such that neither catch 260 nor catch 262 is in engagement with incremental weights 136, (2) selector 242 may be rotated a first angular extent to a second angular position such that catch 260 receives and engages incremental weight 136A while catch 260 remains disengaged from incremental weight 136B (shown in FIG. 11B) and (3) selector 242 may be rotated a second greater angular extent to a third angular position such that both catch 260 and 262 engage incremental weights 136A and 136B, respectively (shown in FIG. 11C). By engaging an incremental weights 136, selector 242 couples incremental weights 136 to top 157, stem 180 and weight lift 135 to add the weight of one or both of incremental weights 136 to the total weight being lifted.

Position indicator 244 provides an audible or tactile feedback to a person indicating the angular positioning of selector 242. As shown by FIG. 11, position indicator 244 includes detents 270A, 270B and 270C (collectively referred to as detents 270), ball detent boss or housing 272 and ball detent 274. Detents 270 comprise depressions or holes formed in plate 252 of selector 242. Detents 270 correspond to distinct angular positions of selector 242 and cooperate with ball detents 274 to indicate the angular positioning of selector 242.

Ball detent housing 272 is supported by top 240 and houses ball detent 274. Ball detent 274 comprises a resiliently biased ball configured to be partially received within one of detents 270. In particular, when the ball of ball detent 274 is within detents 270A, selector 242 is in a first angular position in which neither of weights 136 is engaged by catches 260, 262. When the ball of ball detent 274 is within detent 270B, selector 242 is in the second angular position in which catch 260 is in lifting engagement with incremental weight 136A and catch 262 is out of lifting engagement with incremental weight 136B. When the ball of ball detent 274 is within detent 270C, selector 242 is in the third angular position in which catches 260 and 262 are both in lifting engagement with incremental weights 136A and 136B, respectively. In other embodiments, other risen only biased judges beside a ball, such as a leaf spring and the like may be employed to resiliently engage one of detents 270 to indicate an angular positioning of selector 242. In yet other embodiments, position indicator 244 may be omitted.

Figure 11D:
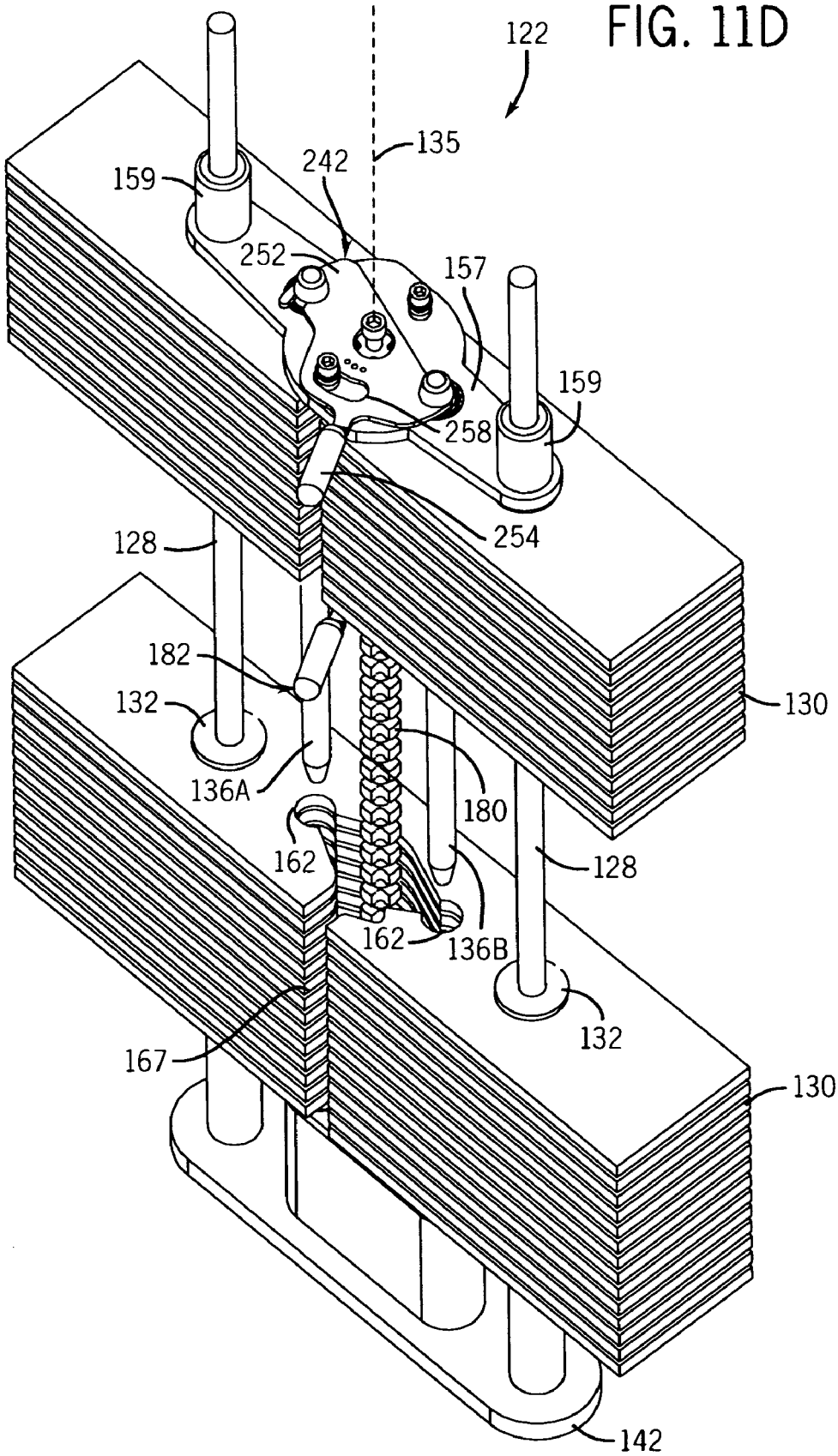
FIG. 11D is a top perspective view of the system of FIG. 2 during lifting of weights while the incremental weight selection system is in the third state according to an example embodiment.

FIG. 11D illustrates a selected number of weights 157 being lifted while selector 242 is in the third angular position (also shown in FIG. 11C) in which both of incremental weights 136 are coupled to weight lift 135. As shown by FIG. 11D, during such lifting, both of weights 136 are pulled and lifted through openings 162. As a result, the weight of incremental weights 136 is added to the total weight being lifted. As noted above, in other embodiments, selector 242 may alternatively be positioned at the second angular position in which only incremental weight 136A is couple weight lift 135 or the first angular position in which neither of incremental weights 136 is coupled to weight lift 135.

Although incremental weight selection system 138 is illustrated as including two catches 260 and 262 for engaging two incremental weights 136, in other embodiments, weight system 122 may be provided with a greater or fewer of such incremental weights 136. Likewise, incremental weight selection system 138 may be configured to selectively engage a greater or fewer of such incremental weights, wherein selector 242 may include additional catches and may have additional or fewer angular positions where different sets of incremental weights are engaged. In yet other embodiments, incremental weights 136 and incremental weight selection system 138 may be omitted or may have other configurations.

Although weight system 122 has been illustrated and described as utilizing selector 182 which is generally not removal from stem 180 by a person using weight system 122, in other embodiments, weight system 122 may include other mechanisms for selecting one or more of weights 130. For example, in one embodiment, selector 182 may be omitted and replaced with an alternative removable selector that is insertable through channel 167 into retaining engagement with stem 180 while being inserted in a selected one of voids 170.

Figure 12:
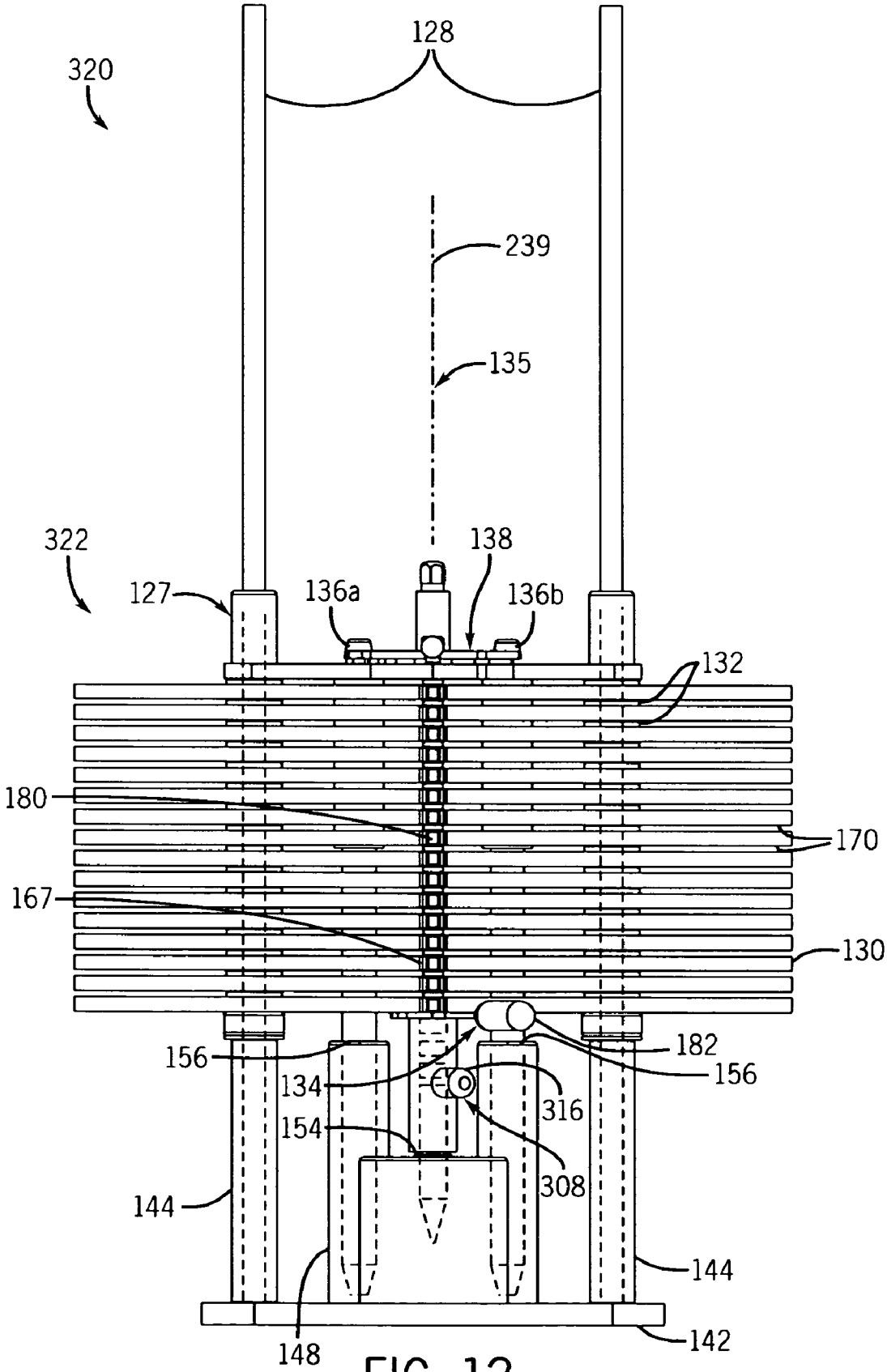
FIG. 12 is a perspective view of another embodiment of the weight system of FIG. 1 according to an example embodiment.
Figure 13:
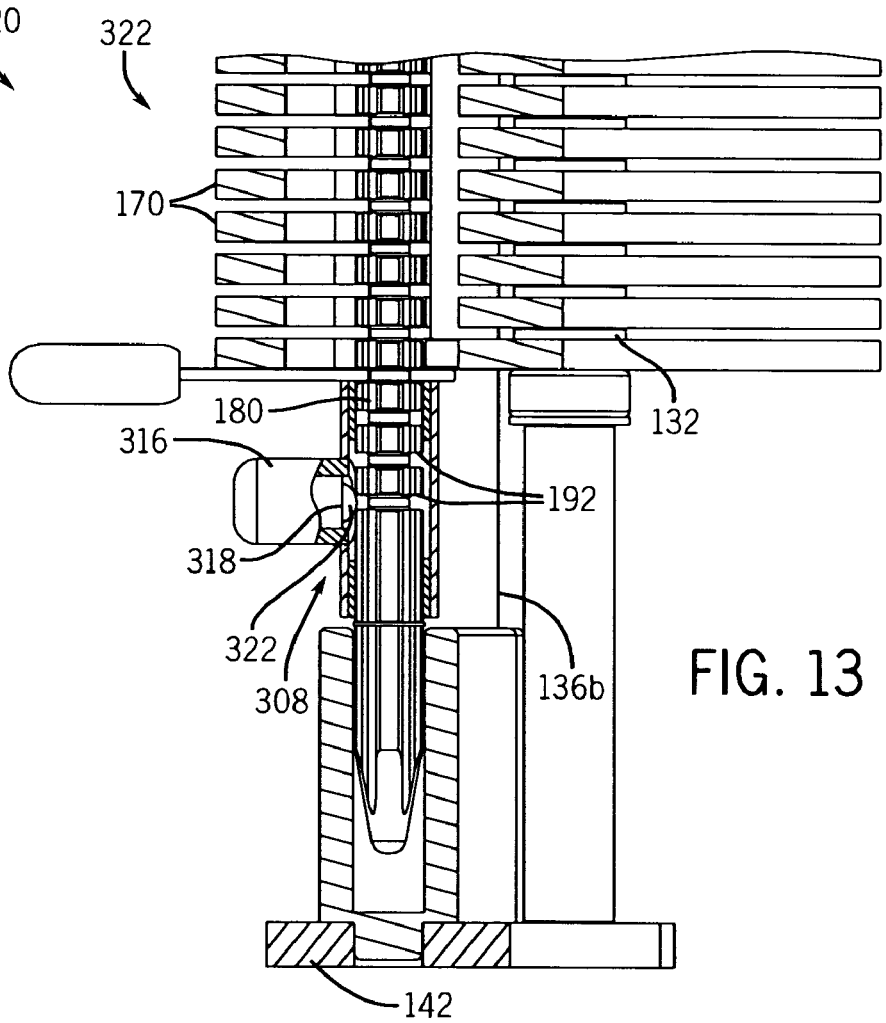
FIG. 13 is a sectional view of the weight system of FIG. 12 according to an example embodiment.

FIGS. 12 and 13 illustrate exercise device 320, another embodiment of exercise device 20 (shown in FIG. 1). Like device 20, device 320 also includes cable system 24 and exercise interface 26 (both of which are shown and described with respect to device 20). Unlike device 20, device 320 includes weight system 322, a specific embodiment of weight system 22. Weight system 322 is similar to weight system 122 except that weight system 322 includes of alignment indicator 308 in place of align indicator 208 (described and illustrated above with respect to FIG. 8). Like alignment indicator 208, alignment indicator 308 comprises a mechanism configured to indicate to a person when engagement projections 210 are in alignment with (horizontally across from) one of voids 170. In the example illustrated, alignment indicator 308 comprises a structure that is resiliently biased in an outward direction from selector 182 into contact with one of spacers 190 along stem 180. Alignment indicator 308 extends into an opposite one of spacers 190 across from one of spacers 190. As selector 182 is raised or lowered and indicator 308 is moved from one of voids 170 to another void 170, alignment indicator 308 resiliently compresses, flexes or otherwise deforms. Alignment indicator 308 provides a clicking sound or a resistance feeling to indicate to a person when selector 182 is in alignment with a selected one of voids 170.

As shown by FIG. 13, alignment indicator 308 utilizes a resiliently biased ball 322. Alignment indicator 308 includes ball detent housing 316 and ball detent 318. Ball detent housing is welded, bonded, fastened otherwise adhered to housing 200 and receives ball detent 318. In the example illustrated, ball detent 318 comprises a ½,-13 threaded spring ball detent commercially available from McMaster Carr. In other embodiments, alignment indicator 308 may comprise other resiliently biased surfaces. In other embodiments, alignment indicator 308 may be omitted.

Those remaining components of exercise device 320 which correspond to exercise device 120 are numbered similarly. Like exercise device 120, exercise device 320 provides a relatively low-cost arrangement of components which enables a person to quickly and easily select a desired amount of weight for an exercise routine.

Figure 14:
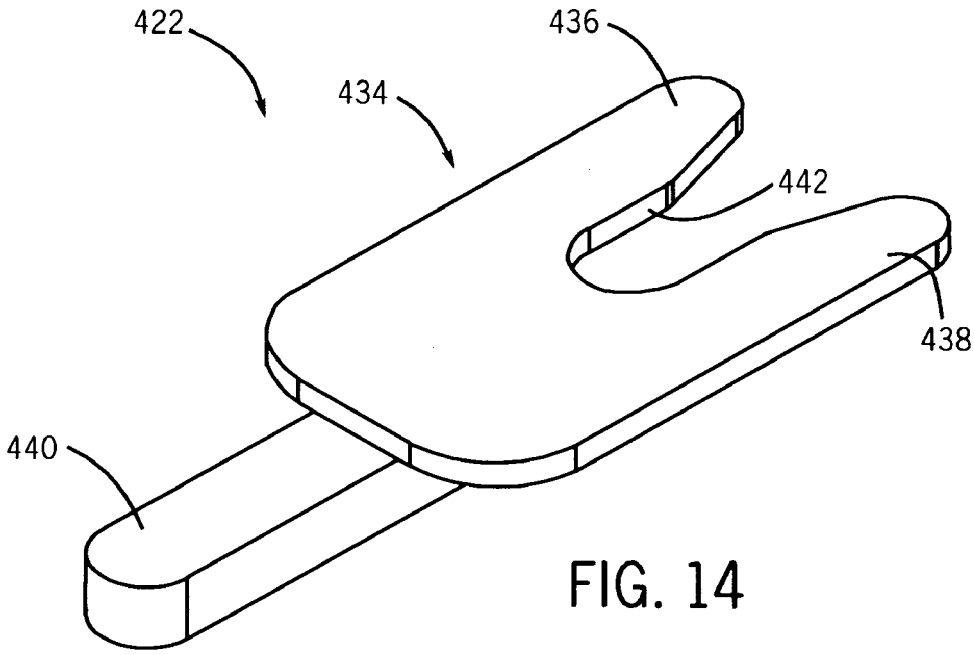
FIG. 14 is a top perspective view of another embodiment of a selector for the system of FIG. 2 according to an example embodiment.

FIG. 14 illustrates weight system 422. Weight system 422 is similar to weight system 122 except that system 422 includes selector 434 (shown in FIG. 12) in lieu of selector 182. The remaining components of system 422 are shown in FIGS. 2-11. Selector 434 is configured to be inserted across and within a selected one of voids 170 and into retaining engagement with stem 180 (shown in FIG. 5). Selector 434 includes prongs 436, 438 and handle 440. Prongs 436, 438 comprise tongs or projections separated by an intermediate opening or slot 442. Prongs 436, 438 have a thickness such that prongs 436 and 438 may be received within a void 170 between consecutive weights 130 (shown in FIG. 2). At the same time, opening 442 is configured to extend about one of spacers 190 between consecutive segments 188 of stem 180 (shown in FIG. 6). As a result, selector 434 may be inserted into a selected void 170 and into retaining engaging with stem 180 such that lifting of stem 180 also lifts those weights 130 above a selected void 170.

Handle 440 comprises an extension extending from a thin plate providing prongs 436 and 438. Handle 430 is configured to extend from prongs 436, 438 through and beyond channel 167. Handle 430 permits a person to insert or withdraw selector 434 in a desired position along the stack of weights 130. In other embodiments, selector 434 may have other configurations.

FIGS. 15-20 illustrate exercise device 520, another embodiment of exercise device 20 (shown in FIG. 1). Like device 20, device 520 also includes cable system 24 and exercise interface 26 (both of which are shown and described with respect to device 20). Unlike device 20, device 520 includes weight system 522, a specific embodiment of weight system 22. Weight system 522 is similar to weight system 122 in that weight system 522 includes base 126, upper guide 127, guide rods 128 and weight lift 135, each of which is shown and described above with respect to weight system 122. Unlike weight system 122, weight system 522 includes weights 530 and the main weight selection system 534 in place of weights 130 and main weight selection system 534.

Weights 530 comprise structures having predetermined weight amounts which are configured to be lifted and to provide a mechanical resistance in an exercise. In the particular example illustrated, weights 530 each comprise a solid or hollow plate of one or more metals. In other embodiments, weights 530 may comprise other materials or may comprise encapsulated materials, such as sand, water or other materials.

Weights 530 are stacked upon one another such that as a particular weight 530 is being lifted, other weights 530 stacked upon the particular weight 530 are also lifted. FIG. 15 illustrates three consecutively stacked weights 530 with the uppermost weight 530 shown being transparent for purposes of illustration. As shown by FIG. 15, each weight 530 includes guide rod openings 560, stem openings 562, selector aperture 564, access channel 566 and void 570. Guide rod openings 560 comprise bores passages extending through each weight 530. Openings 560 of weights 530 are further configured to align with one another when weights 530 are stacked upon one another. Openings 560 are configured to receive guide rods 128. Stem opening 562 comprises a generally centrally located opening through weight 530 configured to slidably receive a stem 580 of weights selection system 534.

Selector aperture 564 comprises an opening extending from opening 562 through weight 530 and configured to receive portions of main weight selection system 534. Selector apertures 564 are configured to be aligned with one another when weights 530 are stacked upon one another. As will be described in more detail hereafter, apertures 564 are configured such that when a portion weight selection system 534 is aligned with or contained within apertures 564, that portion of the weight selection system 534 may move through aperture 564 along and across weights 530. When that portion of weight selection system 534 is moved at least partially out of apertures 564, that portion of weight selection system 534 extends into a void formed between consecutive weights 530 such that all weights 530 overlying that portion of weight selection system 534 may be lifted.

Access channel 566 comprises an opening or passage extending from a perimeter or edge of each weight 530 inwardly to selector aperture 564. Access channel 566 extends generally perpendicular to a longitudinal axis along which weights 530 are stacked and along which each of openings 560 extend or are aligned. Access channel 566 is configured to permit portions of main weight selection system 534 to project from selector aperture 564 to a location in front of weights 534 for access and manipulation by a person. Access channels 566 are aligned with one another, permitting a person to grasp portions of main weight selection system 534 and to move main weight selection system 534 vertically upward and downward through and along a continuous vertical channel 567 formed by the individual access channels 566. As a result, access channel 566 permits a person to move main weight selection system 534 to one of a plurality of available positions along the stack of weights 530 to select a total number of weights 530 or a total weight amount to be lifted.

Void 570 comprises a cavity, depression, recess or other opening configured to receive selector 582 (described below) of main weight selection system 534 when selector 582 is positioned into coupling engagement with stem 580 (described below) of system 534. In the example illustrated, void 570 is formed upon an underside of each weight 530 adjacent to selector a picture 564 and adjacent to stem 580 of the system 534. In the example illustrated, void 570 extends on opposite sides of stem 580 facilitating engagement with opposite side of stem 580 by selector 582. In the example illustrated void 570 is generally rectangular. In other embodiments, void 570 may alternatively be formed on an upper side of each weight 530, may extend adjacent to stem 580 by different extents and may have other shapes. Although void 570 is illustrated as a single continuous void, in other embodiments, void 570 may include distinct spaced portions which receive portions of selector 582. Although void 570 is integrally formed as part of weight 530, reducing the number of parts and simplifying system 522, in other embodiments, void 570 may alternatively be formed by spacers position between and spacing opposite surface of consecutive weights 530.

Main weight selection system 534 comprises a mechanism configured to permit a person to select one or more of weights 530 for lifting during an exercise. Main weight selection system 534 includes selector stem 580 and main selector 182. Selector stem 580 comprises an elongate shaft, bar, rod or other structure coupled to weight lift 135 and movably positioned within selector apertures 564 of weights 530 such that stem 580 may be raised or lowered by weight lift 535. In the particular example illustrated, stem 580 is coupled to weight lift 135. Stem 580 extends along an axis 583 and is configured to slidably support main selector 582 along an axis 583. Selector stem 580 is configured such that selector 582 may be retained relative to stem 580 at a selected one on a plurality of positions along an axis 583 such that selector 582, and any engaged weights 530, will move with movement of stem 580 by weight lift 135.

As shown by FIG. 15, stem 580 includes a tapered end portion 586 and a multitude of segments 588 joined and spaced apart from one another by spacers 590. End portion 586 is configured to be removably received within bore 154 (shown in FIG. 2). End portion 586 generally tapers towards a point along axis 583. In one embodiment, end portion 586 is at least partially conical. Because end portion 586 is tapered, end portion 586 self centers and aligns itself as it is being lowered into bore 154. Because end portion 586 aligns itself into bore 154, other structures or mechanisms otherwise used to provide and precise control over positioning of stem 580 when it is withdrawn from bore 154 when weights 530 are being lifted may be omitted or may be provided with greater tolerances, potentially reducing friction and drag as weights 530 are being lifted to provide a smoother feel. In addition, because end portion 186 aligns itself into bore 154, part tolerances may be increased, reducing cost. For example, because end portion 586 is tapered and self aligning, guide rods 128 do not necessarily have to maintain precise positional control over stem 580 or both portions at the top of weight system 522 connected to stem 580. As a result, the spacing or gap between guide rods 128 and bushings at an upper end of weight system 522 may be increased, reducing friction providing a smoother lifting of weights 530. In other embodiments, tapered end portion 186 may be semi-bulbous or semi-spherical in shape, may be flat or may be omitted.

Segments 588 and spacers 590 alternately extend along axis 583. Each segment 588 is shaped such that selector 182 may be vertically moved along to stem 580. An example illustrated, stem 580 has a circular cross-section reducing fabrication cost and complexity. In other embodiments, stem 580 may have other cross-sections.

Each segment 588 further has a height or thickness substantially equal to a height or thickness of an individual weight 530 extending horizontally across from the particular segment 588. As a result, the gaps 592 provided by spacers 590 are in substantial vertical alignment (horizontally across from) void 570 between weights 530. In the particular example illustrated in which each weight 530 has substantially the same thickness, each of segments 588 also has substantially the same thickness. In other embodiments in which different weights 530 may have different thicknesses, segment 588 may also have different thicknesses so long as each segment 588 has a thickness with substantially equal to the thickness of the particular weight 530 horizontally across from the particular segment 588.

Spacers 590 comprise portions of stem 580 which extend between segments 588 to separate segments 588. Spacers 590 each have a height such that a portion of selector 582 may be captured or received between consecutive segments 588. Each spacer 590 is configured to support and overlying segment 588 such as a top of the segment is substantially horizontally coplanar or coextensive with before of a corresponding void 570 (shown in FIG. 16). According to one embodiment, spacers 590 each have a height substantially equal to a height of a corresponding void 570 (shown in FIG. 16). Spacers 590 permit selector 582 to slide between the first and second positions. Spacers 590 each have a cross-sectional shape dimension smaller than a cross-sectional shape of segments 588.

Selector 582 comprises a mechanism configured to be moved along and at least partially within channel 567 between one of a plurality of multiple selectable positions across from a selected void 570 and to be moved from a withdrawn position to an inserted position in which selector 582 extends between the void and is axially retained relative to stem 580. As a result, when weight lift 135 exerts a lifting force upon stem 580 to lift stem 580, selector 582 and any overlying weights 530 are also lifted. In the particular example illustrated, selector 582 is configured to rotate between the inserted position and the withdrawn position.

As shown by FIG. 17, selector 582 includes support 600 and fork 602. Support 600 comprises a structure configured to slide along stem 580 along axis 583 while slidably supporting fork 602 for movement in a direction perpendicular to axis 583. As shown in FIGS. 19 and 20, support 600 includes a sleeve 606 and a platform 608. Sleeve 600 receives stem 580 and extends about stem 580 so as to slide along stem 580. In one embodiment, sleeve 606 may additionally include internal bearing structures (not shown) that further facilitate slighting movement of sleeve 600 along stem 580.

Platform 608 projects from sleeve 606 and underlies fork 604 across aligned openings 567. Platform 608 provides a base or deck movably supporting and guiding movement of fork 604 substantial perpendicular to axis 583 and stem 580. Although platform 608 is illustrated as underlying fork 604, in other embodiments, platform 604 may alternatively extend over or at least partially contain fork 604.

Fork 604 comprises a structure actuatable or movable along an axis substantially perpendicular to axis 583 between a disengaged position shown in FIGS. 16 and 17 and a disengaged position shown in FIGS. 18 and 19. Fork 604 includes prongs 636, 638 and handle 640. Prongs 636, 638 comprise tongs or projections separated by an intermediate opening or slot 642. Prongs 636, 638 have a thickness such that prongs 636 and 638 may be received within a void 570 between consecutive weights 530 (shown in FIG. 15). At the same time, opening 642 is configured to extend about one of spacers 590 between consecutive segments 588 of stem 580 (shown in FIG. 17). As a result, selector 582 may be inserted into a selected void 570 and into retaining engaging with stem 580 such that lifting of stem 580 also lifts those weights 530 above a selected void 570.

Handle 540 comprises an extension extending from prongs 536 and 538. Handle 530 is configured to extend from prongs 536, 538 through and beyond channel 567 (shown in FIG. 15). Handle 530 permits a person to insert or withdraw selector 582 in a desired position along the stack of weights 530. In other embodiments, selector 582 may have other configurations.

In the example illustrated, fork 604 is movably coupled to platform 608 by means of slot 650 and one or more projections 652. Slot 650 comprises an elongate slot extending along an axis substantially perpendicular to axis 580 in a horizontal plane. Slot 650 receives projections 652.

Projections 652 to comprise structures extending from platform 608 through slot 650. Projections 652 are configured to slide within slot 650 as fork 604 is moved between the engaged and disengaged positions. Projections 652 cooperate with slot 652 guide movement of fork 604.

In the example illustrated, projections 652 have heads 656 (shown in FIG. 17) which are larger than or wider than slot 650 so as to capture fork 604 and retain fork 604 with respect to platform 608. According one embodiment, projections 652 comprise fasteners such as screws, bolts or rivets secured to platform 608 and extending through slot 650. In other embodiments, projections 652 may be integrally formed with platform 608 or of other structures. In still other embodiments, other arrangements may be used to guide movement of fork 604 and retained fork 604 with respect to platform 608. For example, in another embodiment, platform 608 may include a slot, channel or groove while fork 604 includes a projection received within the slot, channel or groove.

FIGS. 16-19 illustrate actuation of fork 604 between the engaged in disengaged positions. FIGS. 16 and 17 illustrate fork 604 in the disengaged position in which fork 604 has been moved in the direction indicated by arrow 660 to withdraw prongs 636, 638 from void 570 and to withdraw stem 580 from opening 642. As a result, selector 582 may be slid within aligned channels 567 and along stem 580 to position fork 604 across from a desired one of gaps 592 and across from one of spacers 590 which correspond to desired number of overlying weights 530 intended to be lifted.

As shown by FIGS. 18 and 19, once selector 582 has been moved within and a long openings 564 to a desired position adjacent to and below a desired weight 530, fork 604 may be moved in a direction perpendicular to axis 583 in a direction indicated by arrow 662 from the disengaged position to the engaged position shown. As a result, opening 642 receives one of spacers 590. Prongs 636, 638 are at least partially received within gap 592 and concurrently project into void 570 connecting the weight 530 providing void 572 stem 580.

As shown by FIG. 20, subsequent lifting of stem 580 by pulling upon lift 135 (shown in FIG. 2) results in selector 582 and overlying weights 530 also being lifted. During such lifting in the direction indicated by arrow 668, sleeve 606 is withdrawn from stem openings 562. To select a different number of weights 530, the person simply lowers the currently lifted weights to their at rest position in which the weights rest upon one another and repeats the process shown in FIGS. 16-19. Overall, main weight selection system 534 facilitates fast and relatively simple selection of weights with a single hand and without complete separation of selector 582 from weights 530 which could otherwise potentially result in selector 582 becoming lost or misplaced.

Although not shown for ease of illustration and discussion, in other embodiments, main weight selection system 534 may include other features noted above. For example, system 534 may additionally include an alignment indicator such as either alignment indicator 208 (shown in FIG. 8 or a lineman indicator 308 (shown in FIG. 13). With alignment indicator 208, sleeve 606 or platform 608 would include a resiliently biased projection configured to project between adjacent weights 530 for us to provide a tactile or audible signal as selector 582 is moved across weights 530. With alignment indicator 308, sleeve 600 would include a resiliently biased projection configured to engage gaps 592 as selector 582 is moved along stem 580. Such an alignment indicator 308 would also provide an audible or tactile (feel) signal indicating movement of selector 582 across weights 530 and between different positions aligned with respect to weights 530 and voids 570.

Although exercise device 520 is illustrated as including weights 530, in other embodiments, weights 530 may additionally be configured to facilitate the additional use of incremental weights 136 and incremental weight selection system 138 described above. In such an embodiment, weights 530 would additionally include openings 162 as shown in FIG. 4. In other embodiments, exercise device 520 may be configured to be utilized with other incremental weight selection systems and other incremental weights. In other embodiments, selector 582 and weights 530 may have other configurations.

Figure 21:
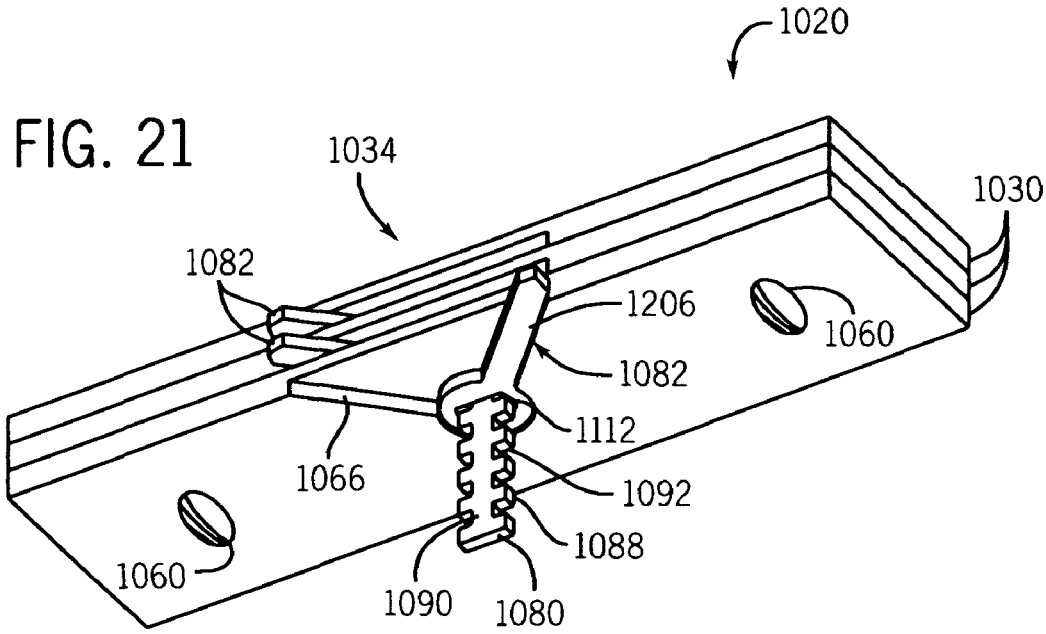
FIG. 21 is a bottom perspective view of another embodiment of the exercise device of FIG. 1 according to an example embodiment.
Figure 22:
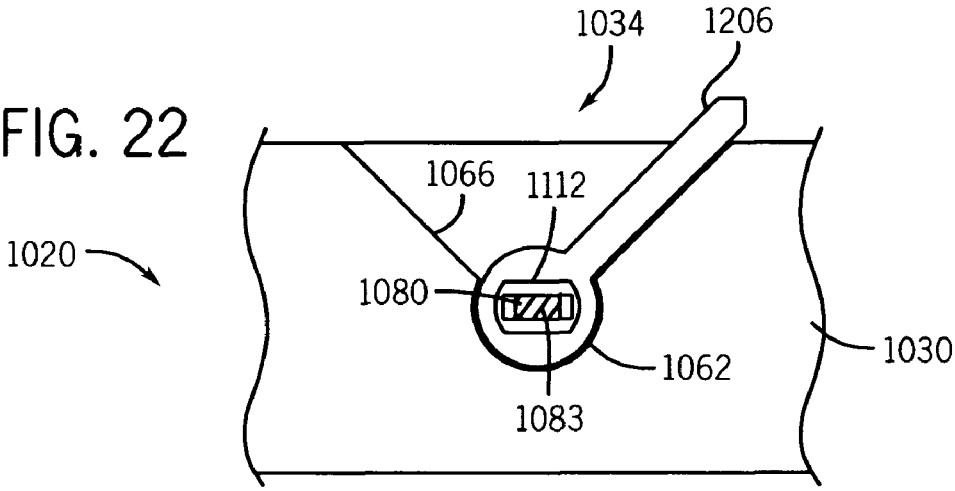
FIG. 22 is a fragmentary bottom plan view of the system of FIG. 21 illustrating a weight selector in a first state according to an example embodiment.
Figure 23:
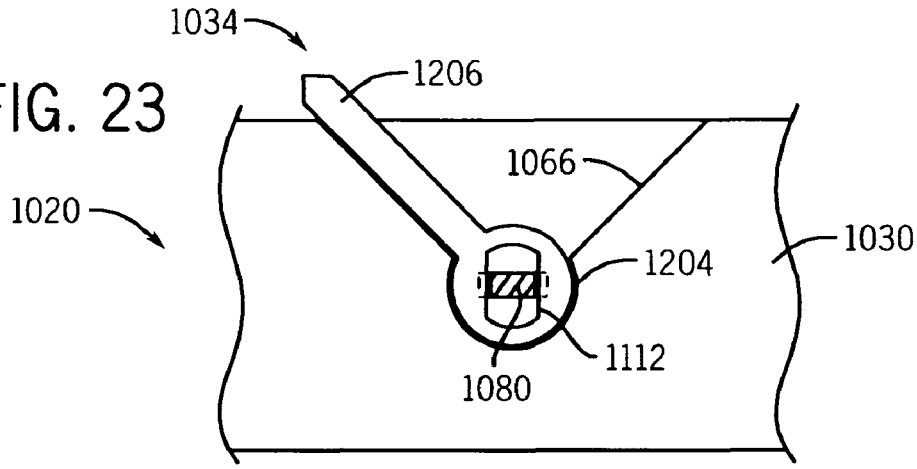
FIG. 23 is a fragmentary bottom plan view of the system of FIG. 22 illustrating the weight selector in a second state according to an example embodiment.

FIGS. 21-23 illustrate exercise device 1020, another embodiment of exercise device 20 (shown in FIG. 1). Like device 20, device 1020 also includes cable system 24 and exercise interface 26 (both of which are shown and described with respect to device 20). Unlike device 20, device 520 includes weight system 1022, a specific embodiment of weight system 22. Weight system 1022 is similar to weight system 1022 in that weight system 1022 includes base 126, upper guide 127, guide rods 128 and weight lift 135, each of which is shown and described above with respect to weight system 122. Unlike weight system 122, weight system 522 includes weights 1030 and the main weight selection system 1034 in place of weights 130 and main weight selection system 534.

Weights 1030 comprise structures having predetermined weight amounts which are configured to be lifted and to provide a mechanical resistance in an exercise. In the particular example illustrated, weights 1030 each comprise a solid or hollow plate of one or more metals. In other embodiments, weights 1030 may comprise other materials or may comprise encapsulated materials, such as sand, water or other materials.

Weights 1030 are stacked upon one another such that as a particular weight 1030 is being lifted, other weights 1030 stacked upon the particular weight 1030 are also lifted. FIG. 21 illustrates three consecutively stacked weights 1030. As shown by FIG. 21, each of weights 1030 includes guide rod openings 160 (shown and described with respect to FIG. 4), stem opening 1062 and access channel 1066. Stem opening 1062 comprises a generally centrally located opening through weight 5100 configured to slidably receive a stem 1080 of weights selection system 1034.

Access channel 1066 comprises an opening or passage extending from a perimeter or edge of each weight 1030 inwardly to stem opening 160. Access channel 1066 extends generally perpendicular to a longitudinal axis along which weights 1030 stacked and alon stem opening 160 which each of openings 160 (shown in FIG. 4) extend or are aligned. Access channel 1066 is configured to permit portions of main weight selection system 1034 (selector 1082) to project to a location in front of weights 1030 for access and manipulation by a person. Access channels 566 further permit movement of portions of main weight selection system 1034. In the example illustrated, each channel 1066 is formed upon an underside of each weight 1030 adjacent to opening 1062 and adjacent to stem 1080 of the system 1034.

Main weight selection system 1034 comprises a mechanism configured to permit a person to select one or more of weights 1030 for lifting during an exercise. Main weight selection system 1034 includes selector stem 1080 and main selector 1082. Selector stem 1080 comprises an elongate shaft, bar, rod or other structure coupled to weight lift 135 (shown in Figure) and movably positioned within stem openings 1062 of weights 1030 such that stem 1080 may be raised or lowered by weight lift 135. Stem 1080 extends along an axis 1083 (shown in FIG. 22) and is configured to slidably support main selector 1082 along an axis 1083. Selector stem 1080 is configured such that selector 1082 may be retained relative to stem 1080 at a selected one on a plurality of positions along an axis 1083 such that selector 1082, when engaging weights 1030, will move with movement of stem 1080 by weight lift 135.

As shown by FIG. 21, stem 1080 includes a multitude of segments 1088 joined and spaced apart from one another by spacers 1090. Segments 1088 and spacers 1090 alternately extend along axis 1083. Each segment 1088 is shaped such that selector 1082 may be rotated about axis 1083 between a first angular position in which selector 1082 may be moved or slid along axis 1083 without substantial interference from segments 1088 and a second angular position in which selector 1082 is retained between two consecutive segments 1088 along axis 1083. In particular, segment 1088 has a cross-sectional shape configured such that each segment 1088 may pass through an opening in selector 1082 when selector 1082 is in a first angular position and is obstructed so as to not pass through the same opening in selector 1082 when selector 1082 is in the second angular position. In the example illustrated, each of the segments 1088 has a non-circular or non-annular cross-sectional shape. In the particular example illustrated, each of the segments 1088 has a non-circular cross-sectional shape which corresponds to a cross-sectional shape of the opening through main selector 1082. In the example illustrated, each segment 1088 has a generally elongated cross-section, such as an oval or rectangle. In other embodiments, segment 188 may have other cross-sectional shapes.

Each segment 1088 further has a height or thickness substantially equal to a height or thickness of an individual weight 1030 extending horizontally across from the particular segment 1088. As a result, selectors 1082 are maintained opposite to gaps 1092 when sandwiched between consecutive weights 1030. In the particular example illustrated in which each weight 1030 has substantially the same thickness, each of segments 1088 also has substantially the same thickness. In other embodiments in which different weights 1030 may have different thicknesses, segments 1088 may also have different thicknesses so long as each segment 1088 has a thickness with substantially equal to the thickness of the particular weight 1030 horizontally across from the particular segment 1088.

Spacers 1090 comprise portions of stem 1080 which extend between segments 1088 to separate segments 1088. Spacers 1090 each have a height such that a portion of selector 1082 may be captured or received between consecutive segments 1088. Each spacer 1090 is configured to support an overlying segment 1088 such as a top of the segment is substantially horizontally coplanar or coextensive with the top of an adjacent weight 1030. According to one embodiment, spacers 1090 each have a height substantially equal to a height of a corresponding weight 1030.

Selectors 1082 comprises mechanisms associated with each weight 1030 in configured to be rotated between a first position and which selector 1082 couples stem 1080 to the associated weight 1030 and a second position in which the associated weight 1030 is decoupled from stem 1080. In the example illustrated, selector 1082 rotates or pivots about axis 1083. Each of selectors 1082 includes an engagement plate 1204 and handle 1206.

Opening 1212 comprises a non-circular opening through plate 1204. Opening 1212 is configured such that when selector 1082 is in a first angular position or orientation shown in FIG. 22, opening 1212 permits stem 1080 to pass therethrough, permitting stem 1080 two removed through and along opening 1062. Opening 1212 is further configured such that when selector 1082 is in a second angular position or orientation, plate 1204 is captured between consecutive segments 1088 such that selector 1082 is retained along stem 1080. In the particular example illustrated, opening 1212 has a shape corresponding to the cross-sectional shape of segments 1088. In the particular example illustrated, opening 1212 has an elongated shape, such as an oval or rectangle. In other embodiments, open 1212 may have different shapes and may have shapes distinct from the shape of segments 1088.

Handle 1206 comprises an extension extending from a plate 1204 through access channels 1066 of weights 1030. Handle 1206 is configured to be manually grasped by a person, permitting a person to rotate opening 1212 between the first angular position which opening 1212 is in alignment with segments 1088 of stem 1080 as shown in FIG. 22 and a second angular position in which opening 1212 is out of alignment with segments 1088 of stem 1080 as shown in FIG. 23.

In the particular example illustrated, a substantial portion of handle 1206 is integrally formed as part of a single unitary body with plate 204, reducing fabrication and assembly costs. In other embodiments, handle 1206 may have other shapes and configurations. In still other embodiments, handle 1206 may be coupled to a powered actuator configured to selectively rotate handle 1206 and opening 1212 between the first and second angular positions. In one embodiment, exercise device 1020 may include a remote control, such as a wired or wireless remote control, for controlling the actuator and for remotely controlling selector 1082.

Figure 24:
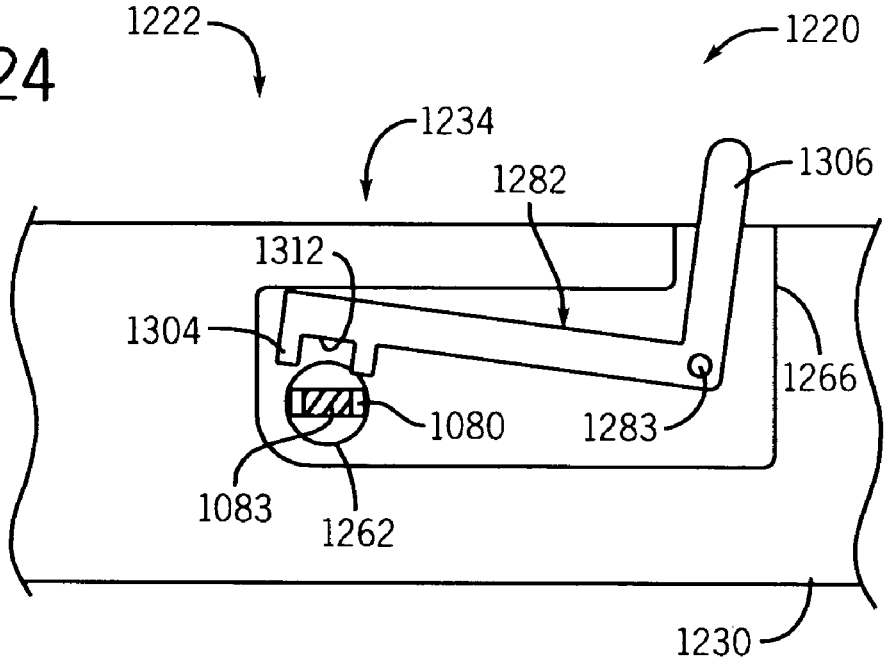
FIG. 24 is a fragmentary bottom plan view of another embodiment of the exercise device of FIG. 1 illustrating a weight selector in a first state according to an example embodiment.
Figure 25:
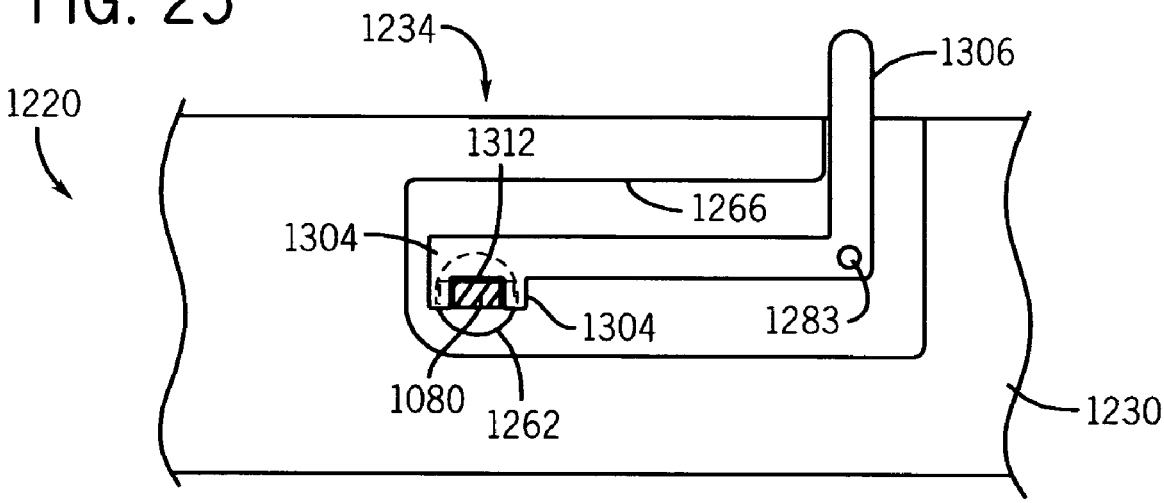
FIG. 25 is a fragmentary bottom plan view of the system of FIG. 24 illustrating the weight selector in a second state according to an example embodiment.

FIGS. 24 and 25 illustrate exercise device 1220, another embodiment of exercise device 20 (shown in FIG. 1). Like device 20, device 1220 also includes cable system 24 and exercise interface 26 (both of which are shown and described with respect to device 20). Unlike device 20, device 520 includes weight system 1222, a specific embodiment of weight system 22. Weight system 1222 is similar to weight system 122 in that weight system 1222 includes base 126, upper guide 127, guide rods 128 and weight lift 135, each of which is shown and described above with respect to weight system 122. Unlike weight system 122, weight system 1022 includes weights 1230 and the main weight selection system 1234 in place of weights 1230 and main weight selection system 1234, respectively.

Weights 1230 comprise structures having predetermined weight amounts which are configured to be lifted and to provide a mechanical resistance in an exercise. In the particular example illustrated, weights 1230 each comprise a solid or hollow plate of one or more metals. In other embodiments, weights 1230 may comprise other materials or may comprise encapsulated materials, such as sand, water or other materials.

Weights 1230 are stacked upon one another such that as a particular weight 1230 is being lifted, other weights 1230 stacked upon the particular weight 1230 are also lifted. Although not shown, each of weights 1230 includes guide rod openings 160 (shown and described with respect to FIG. 4). In addition, each weight 1230 includes stem opening 1262 and access channel 1266. Stem opening 1262 comprises a generally centrally located opening through weight 1230 configured to slidably receive a stem 1080 of weights selection system 1234.

Access channel 1266 comprises an opening or passage extending from a perimeter or edge of each weight 1230 inwardly to stem opening 1262. Access channel 1266 as an L-shaped configuration and extends generally perpendicular to a longitudinal axis along which weights 1230 stacked Access channel 1266 is configured to permit portions of main weight selection system 1234 (selector 1282) to project to a location in front of weights 1230 for access and manipulation by a person. Access channels 1266 further permit movement of portions of main weight selection system 1034. In the example illustrated, each channel 1066 is formed upon an underside of each weight 1230 adjacent to opening 1262 and adjacent to stem 1280 of the system 1234. In other embodiment, access channel 1266 may alternatively be formed on an upper side of an associated weight 1230 when selector 1282 is attached to the particular weight 1230.

Main weight selection system 1234 comprises a mechanism configured to permit a person to select one or more of weights 1230 for lifting during an exercise. Main weight selection system 1234 includes selector stem 1080 (described above with respect to FIGS. 21-23) and main selector 1282.

Selectors 1282 comprises mechanisms associated with each weight 1230 and configured to be rotated or pivoted between a first position and which selector 1282 couples stem 1080 to the associated weight 1230 and a second position in which the associated weight 1230 is decoupled from stem 1080. In the example illustrated, selector 1082 rotates or pivots about axis 1283, an axis parallel to and spaced from axis 1083 of stem 1080. In the example illustrated, each selector 1282 is pivotably pinned to an associated weight 1230 within access channel 1266. Each of selectors 1282 includes an engagement plate 1304 and handle 1306.

Engagement plate 1304 comprises a structure including a notch or opening 1312. Opening 1312 is configured such that when selector 1282 is in a first angular position or orientation shown in FIG. 24, opening 1312 is withdrawn from stem 1080, permitting stem 1080 to pass through the associated weight 1230 such that the associated weight 1230 is not coupled to stem 1080. Opening 1312 is further configured such that when selector 1282 is in a second angular position or orientation shown in FIG. 25, plate 1304 is captured between consecutive segments 1288 such that selector 1282 is retained along stem 1080. In the particular example illustrated, opening 1312 has a rectangular or U-shape. In other embodiments, opening 1312 may have other shapes.

Handle 1306 comprises an extension extending from a plate 1304 through access channels 1266 of weights 1230. Handle 1306 is configured to be manually grasped by a person, permitting a person to rotate opening 1312 between the first angular position which opening 1312 at least partially receives stem 1080 as shown in FIG. 24 and a second angular position in which opening 1312 is withdrawn from stem 1080 as shown in FIG. 25.

In the particular example illustrated, substantial portion of handle 1306 is integrally formed as part of a single unitary body with plate 1304, reducing fabrication and assembly costs. In other embodiments, handle 1306 may have other shapes and configurations. In still other embodiments, handle 1306 may be coupled to a powered actuator configured to selectively rotate handle 1306 and opening 1312 between the first and second angular positions. In one embodiment, exercise device 1220 may include a remote control, such as a wired or wireless remote control, for controlling the actuator and for remotely controlling selector 1282.

Although not shown for ease of illustration and discussion, in other embodiments, main weight selection systems 1034 and 1234 may include other features noted above. For example, system 534 may additionally include an alignment indicator such as either alignment indicator 208 (shown in FIG. 8 or alignment indicator 308 (shown in FIG. 13). With alignment indicator 208, sleeve 606 or platform 608 would include a resiliently biased projection configured to project between adjacent weights 530 for us to provide a tactile or audible signal as selector 582 is moved across weights 530. With alignment indicator 308, sleeve 600 would include a resiliently biased projection configured to engage gaps 592 as selector 582 is moved along stem 580. Such an alignment indicator 308 would also provide an audible or tactile (feel) signal indicating movement of selector 582 across weights 530 and between different positions aligned with respect to weights 530 and voids 570.

Although exercise device 520 is illustrated as including weights 530, in other embodiments, weights 530 may additionally be configured to facilitate the additional use of incremental weights 136 and incremental weight selection system 138 described above. In such an embodiment, weights 530 would additionally include openings 162 as shown in FIG. 4. In other embodiments, exercise device 520 may be configured to be utilized with other incremental weight selection systems and other incremental weights. In other embodiments, selector 582 and weights 530 may have other configurations.

FIGS. 26-29 illustrate exercise device 1420, another embodiment of exercise device 20 (shown in FIG. 1). Like device 20, device 1420 also includes cable system 24 and exercise interface 26 (both of which are shown and described with respect to device 20). Unlike device 20, device 120 includes weight system 1422, a specific embodiment of weight system 22. FIG. 2 is a perspective view of exercise device 1420 and weight system 1422. As will be described hereafter, weight system 1422 is a relatively low-cost arrangement of components which enables a person to quickly and easily select a desired amount of weight for an exercise routine.

Weight system 1422 generally includes base 1426, upper guide 127 (described above with respect to system 120), guide rods 128 (described above with respect to device 120), weights 1430, main weight selection system 1434, weight lift 135 (described above with respect to system 120), incremental weights 1436A, 1436B (collectively referred to as incremental weights 1436) and incremental weight selection system 1438. Base 1426 comprises an arrangement of components configured to serve as a foundation and support for weight system 1422. Base 1426 includes foot 1442, risers 1444 and docks 1448. Foot 1442 supports risers 1444 and docks 1448. Although foot 1442 is illustrated as a plate, in other embodiments, foot 1442 may have other configurations.

Risers 1444 comprise structures extending from foot 1442 that are configured to support guide rods 128. Rises 1444 further engage a lower side of weights 1470 to elevate the stack of weights 1430.

Docks 1448 comprises one or more members configured to remotely receive, support and guide portions incremental weights 1436. Dock 1449 extends from foot 1442 and is configured to remove Lee receive a lower portion of stem 580 main weight selection system 1438. Although docks 1448 and dock 1449 are illustrated as distinct tubular structures, in other embodiments, such docks may have other configurations.

Figure 27A:
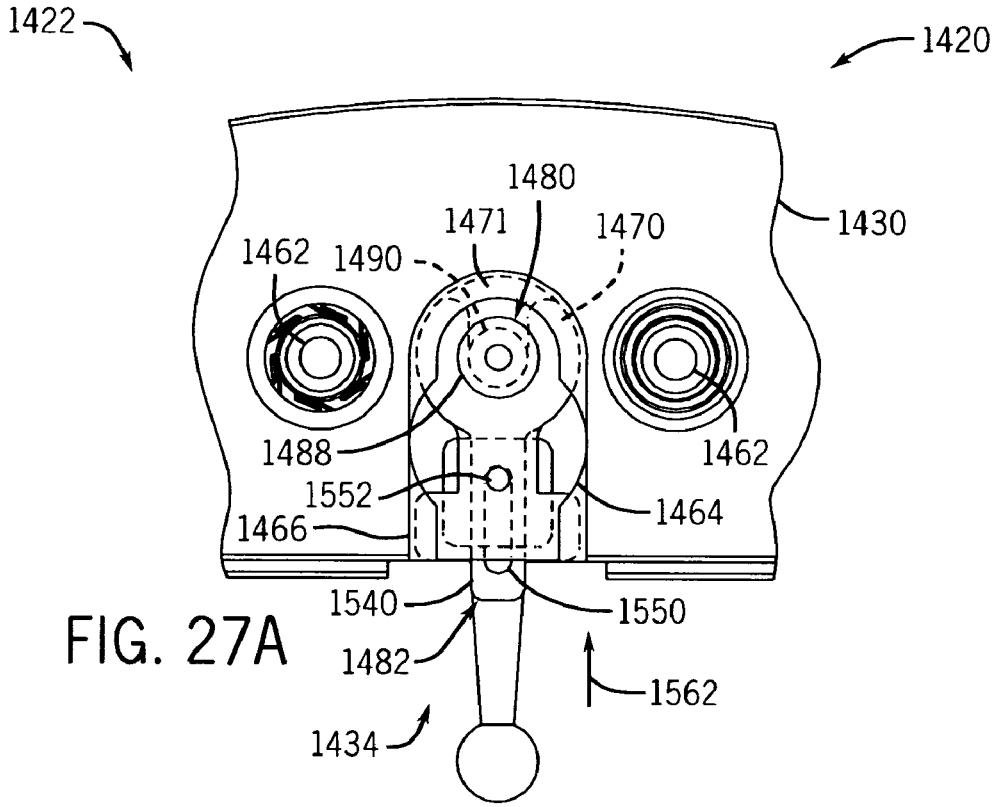
FIG. 27A is a fragmentary top plan view of the system of FIG. 26 illustrating a main weight selector in a first state according to an example embodiment.

Weights 1430 comprise structures having predetermined weight amounts which are configured to be lifted and to provide a mechanical resistance in an exercise. In the particular example illustrated, weights 1430 each comprise a solid or hollow plate of one or more metals. In other embodiments, weights 1430 may comprise other materials or may comprise encapsulated materials, such as sand, water or other materials. Weights 1430 are stacked upon one another such that as a particular weight 1430 is being lifted, other weights 1430 stacked upon the particular weight 1430 are also lifted. Weights 1430 are similar to weights 530 (shown in FIG. 15). As shown by FIG. 27A, each weight 1430 includes guide rod openings 560 (shown in FIG. 15), incremental weight apertures 1462, selector aperture 1464 and access channel 1466. Guide rod openings 160 comprise bores passages extending through weight 1430. Openings 1460 of weight 130 are further configured to align with one another when weights 1430 are stacked upon one another. Openings 160 are configured to receive guide rods 128.

Incremental weight apertures 1462 comprise bores or openings through which incremental weights 1436 extend. Apertures 1462 are configured to be aligned with one another when weights 1430 are stacked upon one another. Incremental weight apertures 1462 generally direct upward or downward movement of the incremental weights 1436 when incremental weights 1436 are being lifted or lowered.

Although incremental weight apertures 1462 are illustrated as comprising distinct apertures, in other embodiments, such apertures 1462 may be connected to one another or may be in communication with selector aperture 1464. In embodiments where weight system 1422 includes a greater or fewer of such incremental weights 1436, each weight 1430 may also include a corresponding fewer or greater of such incremental weight apertures 1462. In particular embodiments where incremental weights 1436 extend across multiple weights 1430 outside or beyond an outer perimeter of weights 1430, incremental weight apertures 1462 may be omitted or may alternatively comprise an inwardly extending cut out along the perimeter of each weight 1430.

Selector aperture 1464 comprises an opening extending from opening 1462 through weight 1430 and configured to receive portions of main weight selection system 1434. Selector apertures 1464 are configured to be aligned with one another when weights 1430 are stacked upon one another. As will be described in more detail hereafter, apertures 1464 are configured such that when a portion weight selection system 1434 is aligned with or contained within apertures 1464, that portion of the weight selection system 1434 may move through aperture 1464 along and across weights 1430. When that portion of weight selection system 1434 is moved at least partially out of apertures 1464, that portion of weight selection system 1434 extends into a void formed between consecutive weights 1430 such that all weights 1430 overlying that portion of weight selection system 1434 may be lifted.

Access channel 1466 comprises an opening or passage extending from a perimeter or edge of each weight 1430 inwardly to selector aperture 1464. Access channel 1466 extends generally perpendicular to a longitudinal axis along which weights 1430 are stacked and along which each of openings 1460 extend or are aligned. Access channel 1466 is configured to permit portions of main weight selection system 1434 to project from selector aperture 1464 to a location in front of weights 1430 for access and manipulation by a person. Access channels 1466 are aligned with one another, permitting a person to grasp portions of main weight selection system 1434 and to move main weight selection system 1434 vertically upward and downward through and along a continuous vertical channel 1467 formed by the individual access channels 566. As a result, access channel 1466 permits a person to move main weight selection system 1434 to one of a plurality of available positions along the stack of weights 1430 to select a total number of weights 1430 or a total weight amount to be lifted.

Void 1470 comprises a cavity, depression, recess or other opening configured to receive selector 1482 (described below) of main weight selection system 1434 when selector 1482 is positioned into coupling engagement with stem 580 (described below) of system 1434. In the example illustrated, void 1470 is formed upon an underside of each weight 1430 below and overlying lip 1471 adjacent to selector aperture 1464 and adjacent to stem 580 of the system 534. In the example illustrated, void 1470 extends on opposite sides of stem 580 facilitating engagement with opposite side of stem 580 by selector 1482. In the example illustrated, void 1470 is generally rectangular. In other embodiments, void 1470 may alternatively be formed on an upper side of each weight 1430, may extend adjacent to stem 580 by different extents and may have other shapes. Although void 1470 is illustrated as a single continuous void, in other embodiments, void 1470 may include distinct spaced portions which receive portions of selector 1482. Although void 1470 is integrally formed as part of weight 1430, reducing the number of parts and simplifying system 1422, in other embodiments, void 1470 may alternatively be formed by spacers position between and spacing opposite surface of consecutive weights 1430.

Main weight selection system 1434 comprises a mechanism configured to permit a person to select one or more of weights 1430 for lifting during an exercise. Main weight selection system 1434 includes selector stem 1480 and main selector 1482.

Figure 26:
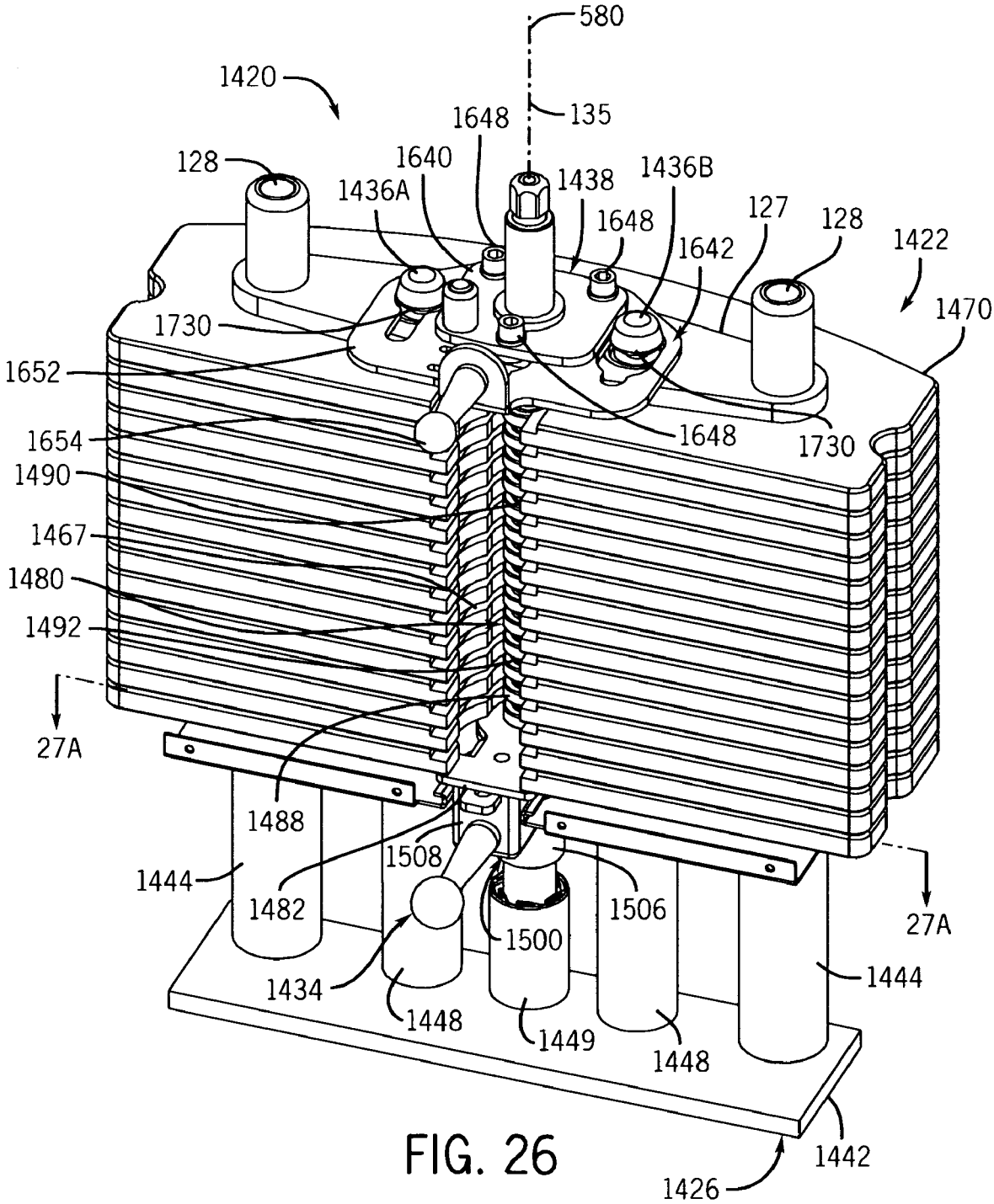
FIG. 26 is a top perspective view of another embodiment of the weight system of FIG. 1 according to an example embodiment.

Selector stem 1480 in substantially similar to selector stem 580. As shown by FIG. 26, stem 1480 includes a multitude of segments 1488 joined and spaced apart from one another by spacers 1490.

Segments 1488 and spacers 1490 alternately extend along axis 483. Each segment 1488 is shaped such that selector 1482 may be vertically moved along to stem 1480. In the example illustrated, stem 1480 has a circular cross-section reducing fabrication cost and complexity. In other embodiments, stem 1480 may have other cross-sections.

Each segment 1488 further has a height or thickness substantially equal to a height or thickness of an individual weight 1430 extending horizontally across from the particular segment 1488. As a result, the gaps 1492 provided by spacers 1490 are in substantial vertical alignment (horizontally across from) void 1470 between weights 1430. In the particular example illustrated in which each weight 1430 has substantially the same thickness, each of segments 1488 also has substantially the same thickness. In other embodiments in which different weights 1430 may have different thicknesses, segment 1488 may also have different thicknesses so long as each segment 1488 has a thickness with substantially equal to the thickness of the particular weight 1430 horizontally across from the particular segment 1488.

Spacers 1490 comprise portions of stem 1480 which extend between segments 1488 to separate segments 1488. Spacers 1490 each have a height such that a portion of selector 1482 may be captured or received between consecutive segments 1488. Each spacer 1490 is configured to support and overlying segment 1488 such as a top of the segment is substantially horizontally coplanar or coextensive with before of a corresponding void 1470 (shown in FIG. 27A). According to one embodiment, spacers 1490 each have a height substantially equal to a height of a corresponding void 1470 (shown in FIG. 27A). Spacers 1490 permit selector 1482 to slide between the first and second positions. Spacers 1490 each have a cross-sectional shape dimension smaller than a cross-sectional shape of segments 1488.

Selector 1482 comprises a mechanism configured to be moved along and at least partially within channel 1467 between one of a plurality of multiple selectable positions across from a selected void 1470 and to be moved from a withdrawn position to an inserted position in which selector 1482 extends between the void and is axially retained relative to stem 1480. As a result, when weight lift 135 exerts a lifting force upon stem 1480 to lift stem 1480, selector 1482 and any overlying weights 1430 are also lifted. In the particular example illustrated, selector 1482 is configured to linearly translate or slide between the inserted position and the withdrawn position.

As shown by FIG. 17, selector 582 includes support 1500 and fork 1502. Support 1500 comprises a structure configured to slide along stem 1480 along axis 1483 while slidably supporting fork 602 for movement in a direction perpendicular to axis 1483. Support 1500 includes a sleeve 1506 and a platform 1508. Sleeve 1500 receives stem 1480 and extends about stem 1480 so as to slide along stem 1480 within the opening formed by lip 1470. In one embodiment, sleeve 1506 may additionally include internal bearing structures (not shown) that further facilitate slighting movement of sleeve 1500 along stem 1480.

Platform 1508 projects from sleeve 1506 and underlies fork 1504 across aligned openings 1467. Platform 1508 provides a base or deck movably supporting and guiding movement of fork 1504 substantial perpendicular to axis 1483 and stem 1480. Although platform 1508 is illustrated as underlying fork 1504, in other embodiments, platform 1504 may alternatively extend over or at least partially contain fork 1504.

Figure 27B:
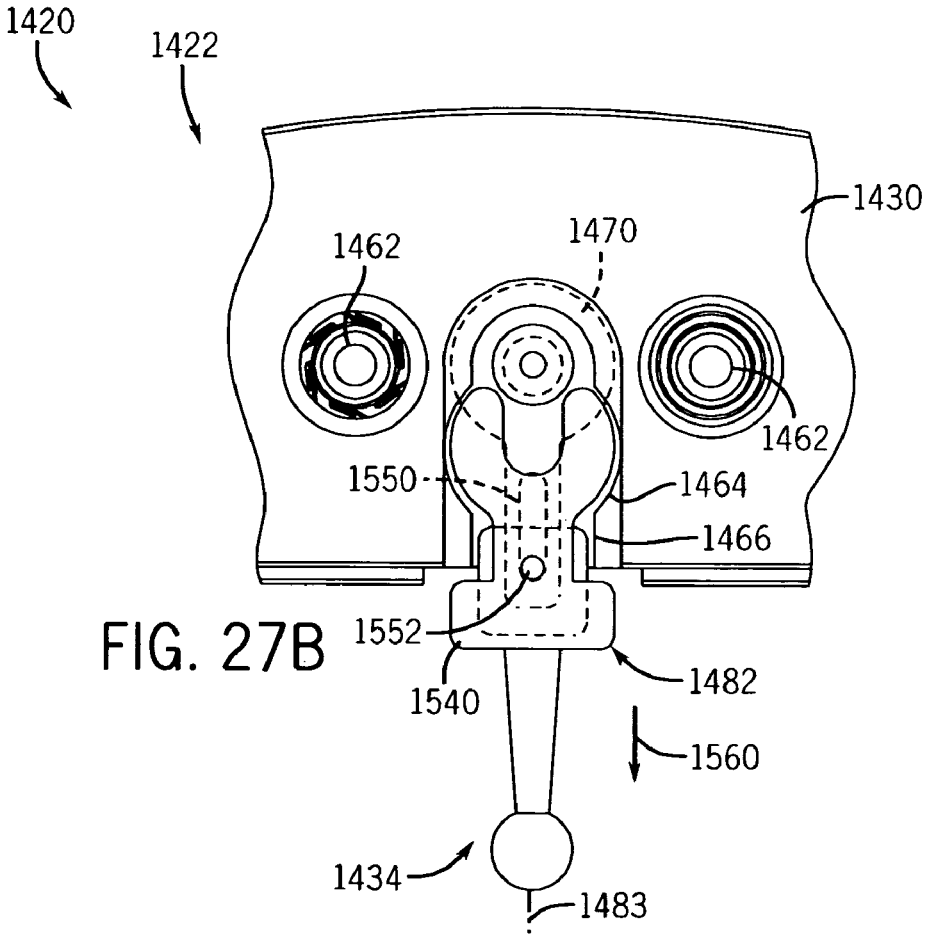
FIG. 27B is a fragmentary top plan view of the system of FIG. 26 illustrating a main weight selector in a second state according to an example embodiment.

Fork 1504 comprises a structure actuatable or movable along an axis substantially perpendicular to axis 1483 between an engaged position shown in FIG. 27A and a disengaged position shown in FIG. 27B. Fork 1504 includes prongs 1536, 1538 and handle 1540. Prongs 1536, 1538 comprise tongs or projections separated by an intermediate opening or slot 1542. Prongs 1536, 1538 have a thickness such that prongs 1536 and 1538 may be received within a void 1470 between consecutive weights 1430. At the same time, opening 1542 is configured to extend about one of spacers 1490 between consecutive segments 1488 of stem 1480 (shown in FIG. 26). As a result, selector 144482 may be inserted into a selected void 1470 and into retaining engaging with stem 1480 such that lifting of stem 1480 also lifts those weights 1430 above a selected void 1470.

Handle 1540 comprises an extension extending from prongs 1536 and 1538. Handle 1540 is configured to extend from prongs 1536, 1538 through and beyond channel 1567. Handle 1530 permits a person to insert or withdraw selector 1482 in a desired position along the stack of weights 1430. In other embodiments, selector 1482 may have other configurations.

In the example illustrated, fork 1504 is movably coupled to platform 1508 by means of slot 1550 and one or more projections 1552. Slot 1550 comprises an elongate slot extending along an axis substantially perpendicular to axis 580 in a horizontal plane. Slot 1550 receives projections 1552.

Projection 1552 to comprises a structure extending from platform 1508 through slot 1550. Projection 1552 is configured to slide within slot 1550 as fork 1504 is moved between the engaged and disengaged positions. Projections 1552 cooperate with slot 1552 guide movement of fork 1504.

groove while fork 604 includes a projection received within the slot, channel or groove.

FIGS. 27A and 27B illustrate actuation of fork 1504 between the engaged in disengaged positions. FIG. 27B illustrates fork 1504 in the disengaged position in which fork 1504 has been moved in the direction indicated by arrow 1560 to withdraw prongs 1536, 1538 from void 1470 and to withdraw stem 1480 from opening 1542. As a result, selector 1482 may be slid within aligned channels 1467 and along stem 1480 to position fork 1504 across from a desired one of gaps 1592 and across from one of spacers 1590 which correspond to desired number of overlying weights 1530 intended to be lifted.

As shown by FIG. 27A, once selector 1482 has been moved within and along openings 1464 to a desired position adjacent to and below a desired weight 1430, fork 1504 may be moved in a direction perpendicular to axis 580 in a direction indicated by arrow 1562 from the disengaged position to the engaged position shown. As a result, opening 1542 receives one of spacers 1490. Prongs 1536, 1538 are at least partially received within gap 1492 and concurrently project into void 1470 connecting the weight 1430 providing void 1470 to stem 1480.

Although not shown for ease of illustration and discussion, in other embodiments, main weight selection system 1434 may include other features noted above. For example, system 534 may additionally include an alignment indicator such as either alignment indicator 208 (shown in FIG. 8 or a lineman indicator 308 (shown in FIG. 13). With alignment indicator 208, sleeve 1506 or platform 1508 would include a resiliently biased projection configured to project between adjacent weights 1430 for us to provide a tactile or audible signal as selector 1482 is moved across weights 1430. With alignment indicator 308, sleeve 1500 would include a resiliently biased projection configured to engage gaps 1492 as selector 1482 is moved along stem 1480. Such an alignment indicator 308 would also provide an audible or tactile (feel) signal indicating movement of selector 1482 across weights 1430 and between different positions aligned with respect to weights 1430 and voids 1470.

Figure 28A:
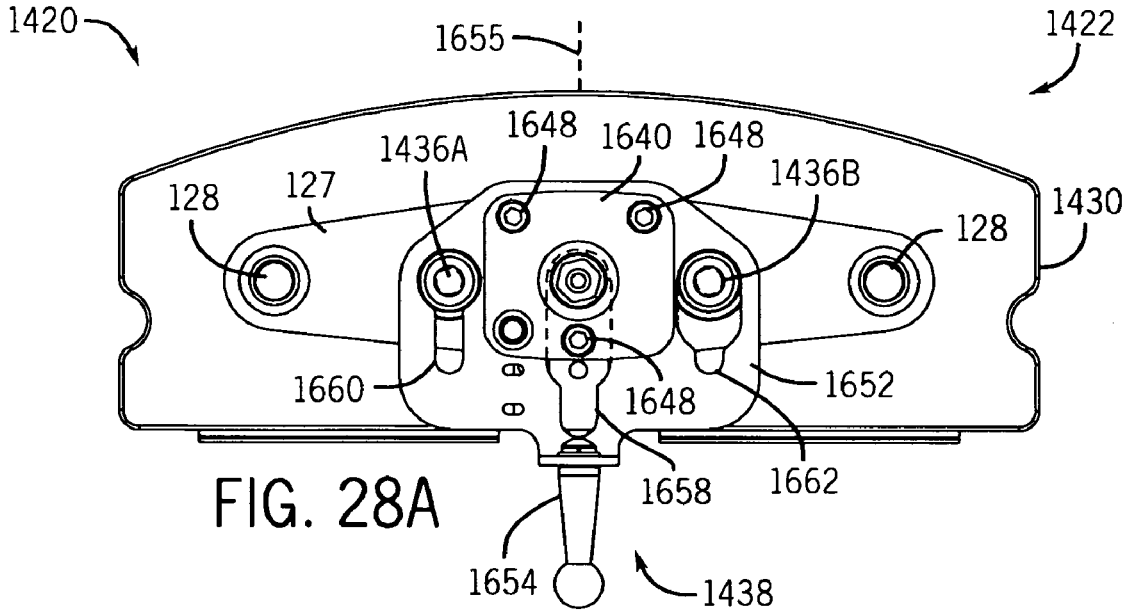
FIG. 28A is a fragmentary top plan view of the system of FIG. 26 illustrating an incremental weight selection system in a first state in which no incremental weights are engaged according to an example embodiment.
Figure 28B:
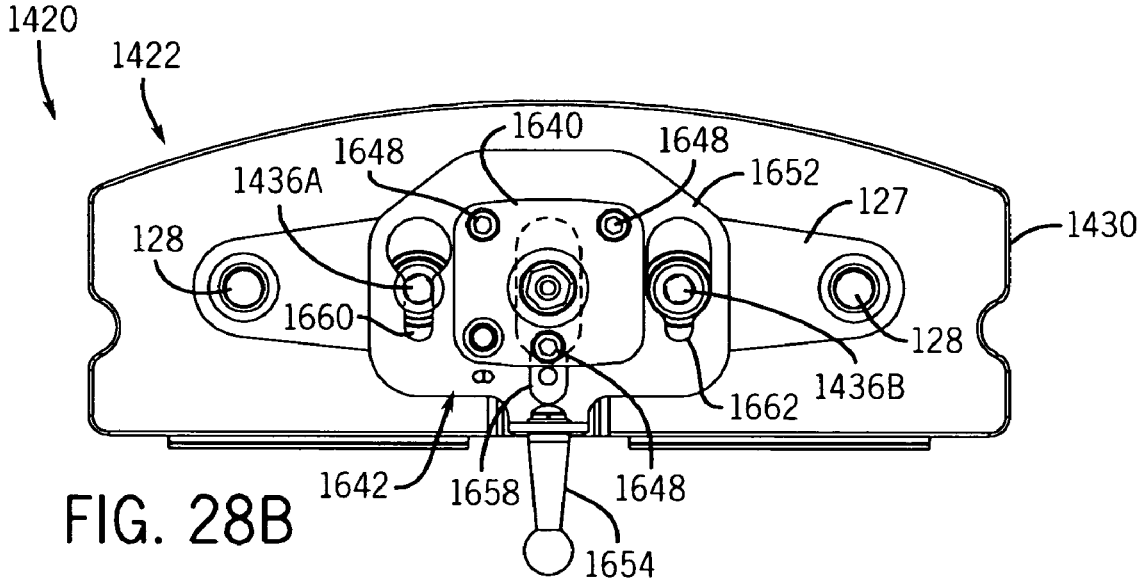
FIG. 28B is a fragmentary top plan view of the system of FIG. 26 illustrating the incremental weight selection system in a second state in which an incremental weight is engaged according to an example embodiment.
Figure 28C:
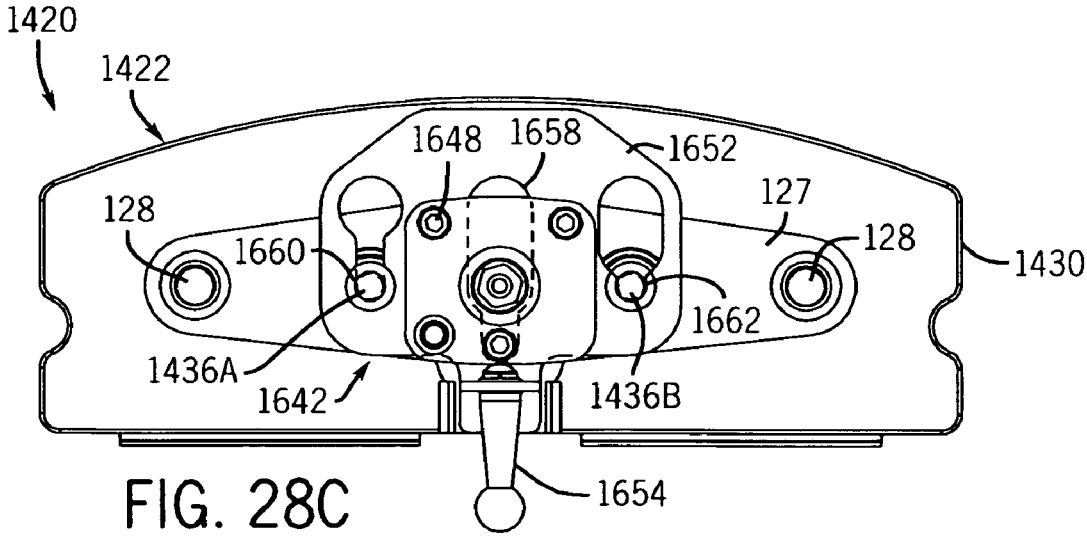
FIG. 28C is a fragmentary top plan view of the system of FIG. 26 illustrating the incremental weight selection system in a third state in which a plurality of incremental weights are engaged according to an example embodiment.

FIGS. 28A-28C illustrate incremental weights 1436 in more detail. As shown by FIG. 10, incremental weights 1436 comprise elongate rods having a predetermined weight. According to one embodiment, weights 1436 have individual weight amounts which are distinct from the individual weight amounts of weights 1430. In one embodiment, weights 1430 have a weight of 15 pounds while each of incremental weights 1436A and 1436B have a weight of 5 pounds. In another embodiment, weight 1436A may have an incremental weight amount one-half that of weights 1430 and weight 1436B may have an incremental weight amount one-quarter that of weights 1430. In one embodiment, each of weights 1430 weighs 10 pounds while incremental weights 1436A and 1436B weigh 5 pounds and 2.5 pounds, respectively. In still other embodiments, weights 1436 may have other weight increments distinct from weights 1430.

Incremental weights 1436 extend through openings 1462 (shown in FIG. 27A) in weights 1430 so as to extend vertically across multiple weights 1430. As a result, weights 1436 do not substantially increase the height, width or length of weights system 1422. Weights 1436 remain partially hidden for a cleaner more compact appearance. As for further shown by FIG. 26, each of weights 1436 have a lower end received within dock 1448 and upper ends which include grooves or channels 1730 configured to receive portions of incremental weight selection system 1438.

Incremental weight selection system 1438 is configured to enable a person to select one or both of weights 1436 for addition to the total amount of weight largely determined by main weights 1430. As shown by FIG. 26, system 1438 includes top 1640 and selector 1642. Top 1640 is mounted to top plate 157 by fasteners 1648 which pass through elongated slot in selector 1642 so as to capture selector 1642 between top 1640 and top plate 157 while permitting selector 1642 to slide. Although illustrated as being rectangular, top 1640 man various shapes and configurations.

Selector 1642 comprises a member configured to be linearly translated or rotated along an axis substantially perpendicular to axis 580 of stem 180 so as to selectively engage incremental weights 1436. Selector 1642 includes plate 1652 and handle 1654. Plate 1652 serves as a body for selector 1642. Plate 1652 includes slot 1658, catch 1660 and catch 1662. Slot 1658 comprises an elongate arcuate opening through plate 1652 configured to receive one of fastener 1648. Slot 1658 guides in your translation or sliding movement of selector 1642 along axis 1655 which is substantially perpendicular to axis 580 of stem 1480.

Catches 1660 and 1662 comprise generally horizontal slots or notches formed in plate 1652 that are narrower than the upper had portions of weights 1436. Catches 1660 and 1662 are configured to receive upper portions of weights 1436 such that portions of plate 252 extend about weights 1436 within grooves 1730. Catches 1660 and 1662 are spaced from one another in a direction along axis 1655 with respect to one another such that: (1) selector 1642 may be linearly translated to a first position (shown in FIG. 28A) such that neither catch 1660 nor catch 1662 is in engagement with incremental weights 1436, (2) selector 1642 may be linearly translated a first linear extent to a second position such that catch 1660 receives and engages incremental weight 1436A while catch 1660 remains disengaged from incremental weight 1436B (shown in FIG. 28B) and (3) selector 1642 may be linearly translated a second greater linear extent to a third position such that both catch 1660 and 1662 engage incremental weights 1436A and 1436B, respectively (shown in FIG. 28C). By engaging an incremental weights 1436, selector 1642 couples incremental weights 1436 to top 157, stem 1480 and weight lift 135 to add the weight of one or both of incremental weights 1436 to the total weight being lifted.

Although incremental weight selection system 1438 is illustrated as including two catches 1660 and 1662 for engaging two incremental weights 1436, in other embodiments, weight system 1422 may be provided with a greater or fewer of such incremental weights 1436. Likewise, incremental weight selection system 1438 may be configured to selectively engage a greater or fewer of such incremental weights, wherein selector 1642 may include additional catches and may have additional or fewer positions where different sets of incremental weights are engaged. In yet other embodiments, incremental weights 1436 and incremental weight selection system 1438 may be omitted or may have other configurations.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A weight system comprising:

a weight lift;

weights, at least portions of which are separated by voids; and a first selector coupled to the weight lift and movably supported along a first axis along the weights, the selector being movable between an inserted position in a selected one of the voids and a withdrawn position;

a first incremental weight vertically extending across at least two of the weights; and a second selector configured to selectively couple the first incremental weight to the weight lift, wherein the first incremental weight comprises a rod extending through the weights.

2. The weight system of claim 1 further comprising a rod coupled to the weight lift and slidably supporting the selector.

3. The weight system of claim 2 further comprising a base including a bore, wherein the rod has an at least partially conical end removably received within the bore.

4. The weight system of claim 2, wherein the selector is rotatable about an axis of the rod between a first angular position in which the selector is slidable along the axis and a second angular position in which the selector is retained along the axis relative to the rod.

5. The weight system of claim 2, wherein the selector is slidable along a second axis perpendicular to the first axis between a first position in which the selector is slidably retained along the first axis relative to the rod and a second position in which the selector is movable along the first axis relative to the rod.

6. The weight system of claim 2, wherein the rod includes a plurality of axially spaced segments.

7. The weight system of claim 2, wherein the selector includes a tubular portion at least surrounding the rod by greater than or equal to about 180 degrees.

8. The weight system of claim 1 further comprising a stem extending along the first axis and coupled to the weight lift and including spaced segments axially joined by spacers and wherein the selector includes spaced prongs rotatable about the axis and the spacers to a position between the segments.

9. The weight system of claim 1, wherein the weights include aligned channels adjacent the voids through which the selector moves along the weights.

10. The weight system of claim 1, wherein the selector includes a first projection and a second projection and wherein the first projection and the second projection extend into opposite portions of a void when the selector is in the inserted position.

11. The weight system of claim 1, wherein adjacent weights are separated by voids horizontally across from one another.

12. The weight system of claim 1, wherein weights includes an upper weight having a lower surface and a lower weight having upper surface opposite to lower surface and wherein a majority of the upper surface and a lower surface are separated by one of the voids.

13. The weight system of claim 1 further comprising:

a guide rod extending through the weights; and a bushing between each weight, each bushing slidably guiding movement of the weight along the rod and spacing one of the weights from a consecutive weight to form one of the voids.

14. The weight system of claim 1, wherein the second selector rotates between a first position in which the first incremental weight is coupled to the weight lift and a second decoupled position in which the first incremental weight is decoupled to the weight lift.

15. The weight system of claim 1, further comprising a second incremental weight vertically extending across at least two of the weights, wherein the second selector is configured to selectively couple the second incremental weight to the weight lift.

16. The weight system of claim 1 further comprising a resiliently biased projection coupled to the selector and configured to resiliently project into the voids and out of the voids as the selector is slid along the weights.

17. The weight system of claim 1 further comprising:

a rod coupled to the weight lift and slidably supporting the selector, the rod including a plurality of axial spaces; and a resiliently biased projection coupled to the selector and configured to resiliently project into spaces and out of the spaces as the selector is slid along the weights.

18. The weight system of claim 1, wherein each void comprises a space which is empty except when receiving the first selector.

* * * * *